US010266305B2

(12) United States Patent
Lee et al.

(10) Patent No.: US 10,266,305 B2
(45) Date of Patent: Apr. 23, 2019

(54) COMPARTMENTALIZATION ASSEMBLY

(71) Applicant: Jane Lee, Brentwood, TN (US)

(72) Inventors: Catherine Jane Lee, Brentwood, TN (US); Brian D. Smith, Cookeville, TN (US)

(73) Assignee: JANE LEE, Brentwood, TN (US)

( * ) Notice: Subject to any disclaimer, the term of this patent is extended or adjusted under 35 U.S.C. 154(b) by 31 days.

(21) Appl. No.: 15/695,146

(22) Filed: Sep. 5, 2017

(65) Prior Publication Data

US 2017/0361987 A1 Dec. 21, 2017

Related U.S. Application Data

(63) Continuation-in-part of application No. 14/796,035, filed on Jul. 10, 2015, now abandoned.

(60) Provisional application No. 62/137,527, filed on Mar. 24, 2015.

(51) Int. Cl.
*B65D 25/06* (2006.01)
*B65D 43/02* (2006.01)

(52) U.S. Cl.
CPC ..... *B65D 25/06* (2013.01); *B65D 43/02* (2013.01)

(58) Field of Classification Search
CPC ..... B65D 25/06; B65D 2590/0091; B65D 25/04; B65D 2543/00296; B65D 81/02
See application file for complete search history.

(56) References Cited

U.S. PATENT DOCUMENTS 4,538,737 A * 9/1985 Delaney ..... B60P 7/0892 206/560
4,798,292 A * 1/1989 Hauze ..... A61L 2/26 206/439
6,634,499 B2 * 10/2003 Allen ..... A61L 2/26 206/370
2008/0083753 A1 * 4/2008 Escobar ..... B65D 25/06 220/8

* cited by examiner

*Primary Examiner* — Shawn M Braden
(74) *Attorney, Agent, or Firm* — Shane V. Cortesi

(57) ABSTRACT

A compartmentalization assembly is provided. The compartmentalization assembly includes a base having a surface with shaft seats and at least one separator including a panel and one or more shafts, each of the shafts can each be fittingly received into one of the shaft seats.

22 Claims, 26 Drawing Sheets

COMPARTMENTALIZATION ASSEMBLY

RELATED APPLICATIONS

This application is a continuation-in-part of U.S. application Ser. No. 14/796,035, filed Jul. 10, 2015, which claims the benefit of U.S. Provisional Application No. 62/137,527, filed Mar. 24, 2015. The aforementioned applications are incorporated by reference herein in their entirety.

BACKGROUND OF THE INVENTION

The present invention relates to storage containers with lids, more particularly, storage containers with removable partitions that allow for compartmentalization.

Containers having compartments are used in many areas of everyday living. Cosmetics; fingernail supplies; art supplies; small tools; screws, nails and fittings; and silverware, among other things, are stored in containers having separate compartments. Some items, such as silverware, which have standard sizes, are often stored in containers having specifically sized compartments particularly suitable for their intended purpose and which cannot be altered to have compartments of different dimensions and numbers. Others correspond to compartments, which, although not specifically shaped to foreclose other uses, are limited in that the defined compartments parcel container space into unalterable subspaces. Thus, with a new use, subspaces of unusable size remain empty. Other designs include containers having one or more removable complex dividers, which, in use, are fixed within the container. For complex dividers which are entire, the walls of the container generally function to immobilize the divider. In some of these designs, subdividers are present to provide a degree of subspace adjustability, in some cases, being immobilized by projections or embedded slots in the divider or compartment walls. Yet another container design includes a divider which spans one dimension of a square or rectangular container, being movable in the other dimension along a track recessed in the bottom of the container. The divider functions to give a rudimentary adjustment in one dimension, of the sizes of adjacent subspaces which, as indicated above, together form a square or rectangle. The inability to modify the compartmentalization of a container greatly limits its usefulness. Present designs which do have a modicum of flexibility still do not give a container which can be customized to give multiple subspaces of adjustable widths and lengths. Accordingly, a container having such customizable compartments would be welcomed in the art.

BRIEF SUMMARY

The invention meets the foregoing and/or other needs by providing at least in some aspects of the invention, a compartmentalization assembly including a base having a surface with shaft seats, and at least one separator including a panel and one or more shafts, each of the shafts can each be fittingly received into one of said shaft seats.

In still further embodiments, the present disclosure provides a compartmentalization assembly comprising: a) a base comprising a plurality of apertures; and b) a plurality of separators, each separator comprising a panel having a panel height, a panel length generally perpendicular to the panel height, and a panel width generally perpendicular to the panel height and panel length, and a peg extending generally downward from the panel and comprising a peg bottom, a peg top, a peg height generally parallel to the panel height, a peg length generally parallel to the panel length, and a peg width generally parallel to the panel width.

Optionally, each peg further comprises a plurality of arms and a slot extending upward from the peg bottom toward the peg top, the slot separating the plurality of arms. Optionally, the plurality of apertures each comprise a segment that is generally in the shape of a star with a central rectangular bore (more preferably a square-shape bore) and a plurality of projections spaced evenly apart around the rectangular bore and radiating from the rectangular bore at different angles. Optionally, each peg is configured to removably lock to an aperture at a plurality of angles by inserting a peg into an aperture at the plurality of angles. Optionally, each aperture has eight triangular projections, the eight triangular projections having substantially the same size, and further wherein each peg has four sides, and further wherein the peg lengths are substantially equal to the peg widths. For example, if the aperture has eight triangular projections, the apices of the triangular projections may be located 45 degrees apart (i.e., the first apex will point at 0 degrees, the second apex will point at 45 degrees, the third apex will point at 90 degrees, the fourth apex will point at 135 degrees, the fifth apex will point at 180 degrees, the sixth apex will point at 225 degrees, the seventh apex will point at 270 degrees, and the eighth apex will point at 315 degrees). Optionally, the slot extends the full width but not the full length of each peg. Optionally, each peg has a relaxed state in which the plurality arms of the peg are located a first distance apart and a compressed state in which the plurality of arms of the peg are located a second distance apart, the second distance less than the first distance, and further wherein insertion of the peg downwardly into the aperture is configured to automatically cause the peg to move from the relaxed state to the compressed state (e.g., insertion of the peg into the aperture does not require the user to squeeze the peg arms together). Optionally, the segments of the plurality of apertures are in the shape of a squared octagonal star. Optionally, insertion of the peg downwardly into the aperture is configured to cause the peg to enter the rectangular bore and some but not all of the projections. Optionally, the base and pegs are semi-rigid or rigid. Optionally, the peg bottom comprises at least two rounded edges. Optionally, the plurality of apertures are spaced apart at regular intervals. Optionally, the plurality of apertures are evenly distributed about the base and arranged in a plurality of rows and columns. Optionally, the panels are generally rectangular in shape. Optionally, the compartmentalization assembly further comprises at least one wall extending upwardly above the base, and an open top opposite the base. Optionally, the at least one wall and the base form a container, and further wherein the at least one wall comprises a top end forming a rim of the container. Optionally, the compartmentalization assembly further comprises a removable lid to removably close the open top. Optionally, the lid comprises a top surface, a bottom surface opposite the top surface and configured to face the base, a groove extending around the bottom surface and a plurality of tabs on opposite sides of the groove, and further wherein each wall is configured to removably lock to the lid by inserting the wall upwardly into the groove. Optionally, the lid comprises a top surface comprising at least one wall extending about a perimeter of the top surface and forming a top surface recess, wherein the container further comprises a container bottom, and further wherein the container bottom is configured to rest on the top surface recess. Optionally, the lid and the base and optionally the panels are generally rectangular in shape. Optionally, insertion of the at least one wall upwardly into the groove is configured to cause tabs on opposite of the groove to move away from each other/flex to allow the lid to removably lock to the at least one wall. Optionally, the base comprises a base height, wherein each aperture has an aperture height generally parallel to the base height and further wherein each aperture extends through the base height. Optionally, when a peg of a separator is inserted downward and locked into an aperture, the separator is located below the rim. Optionally, the plurality of apertures are approximately the same size and shape. Optionally, each panel has a single peg located approximately in the center of the panel length. Optionally, the panel of a separator comprises a panel bottom confronting the base when the peg is inserted downwardly into the aperture.

In still further embodiments, the present disclosure provides a method of utilizing a compartmentalization assembly comprising the steps of: a) providing the compartmentalization assembly; and b) inserting a peg of a separator downwardly into an aperture to removably lock the separator to the base. Optionally, the method further comprises: c) removing the peg from the aperture; d)rotating the peg; and e) re-inserting the peg into the aperture.

The above brief summary of the invention presents a simplified summary of the claimed subject matter in order to provide a basic understanding of some aspects of the claimed subject matter. This summary is not an extensive overview of the claimed subject matter. It is intended to neither identify key or critical elements of the claimed subject matter nor delineate the scope of the claimed subject matter. Its sole purpose is to present some concepts of the claimed subject matter in a simplified form as a prelude to the more detailed description that is presented below.

Additionally, the above brief summary has outlined rather broadly the features and technical advantages of the present invention in order that the detailed description of the invention that follows may be understood. Additional features and advantages of the invention will be described hereinafter, which form the subject of the claims of the invention. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features, which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings illustrate preferred embodiments of this invention. However, it is to be understood that these embodiments are not intended to be exhaustive, nor limiting of the invention. These embodiments are but examples of some of the forms in which the invention may be practiced. Like reference numbers or symbols employed across the several figures are employed to refer to like parts or components illustrated therein.

in FIG. 28, the peg of a separator has been inserted downwardly into the aperture to removably lock the separator to the base.

in FIG. 29, the pegs of several separators has been inserted downwardly into the apertures to removably lock the separators to the base; as shown in FIG. 29, the separators may be removably locked at different angles due to the star-shaped aperture.

in FIG. 33, the compartmentalization assembly has been inverted.

DETAILED DESCRIPTION

Figure 1A:
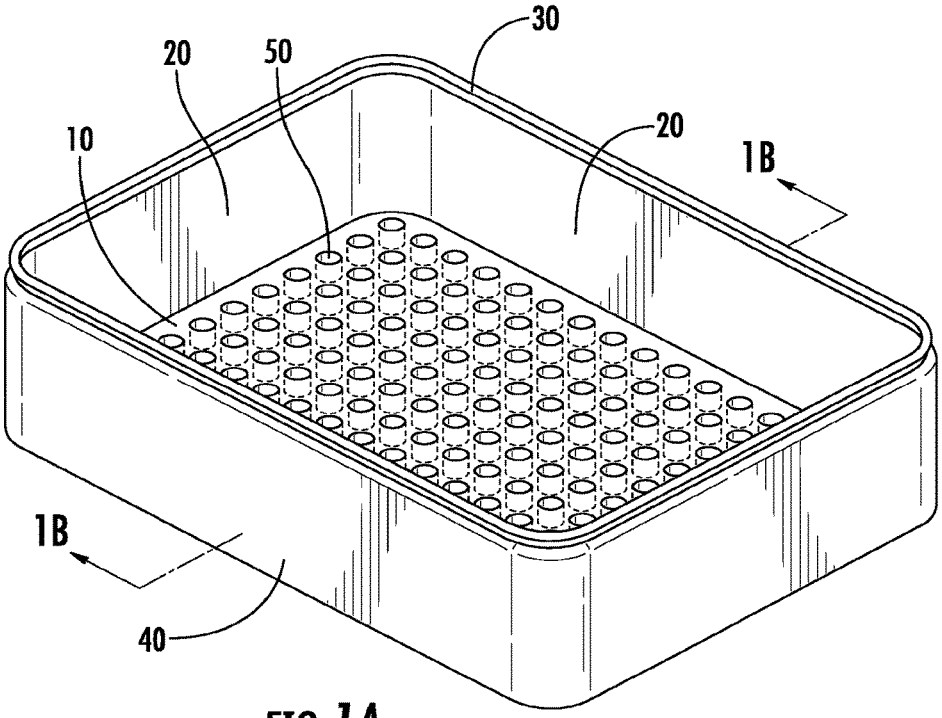
FIG. 1A depicts an offset top view of a walled base irremovably disposed inside a container with round shaft seats touching the floor of the container.

With reference to FIGS. 1-16, the present disclosure provides a compartmentalization assembly generally denoted by the numeral 1. In the drawings, not all parts are labelled in each part for clarity.

Referring further to FIGS. 1-16, the compartmentalization assembly 1 may include a container 40 comprising a base 10 which comprises a surface, said surface comprising shaft/peg seats (preferably in the form of apertures 50) and at least one separator 60, said separator 60 comprising a panel and one or more shafts/pegs 70, each of which extends in the plane of or parallel to the plane of the panel, wherein each of said one or more shafts/pegs 70 is characterized by a cross section shaped such that each of the shafts/pegs 70 can each be fittingly received into one of said apertures 50. The base 10 can generally be of a material which is sturdy enough to support the separators 60 in an upright position. Exemplary materials of construction include one or more of plastic materials, ceramic materials, metals and wood. Plastic materials are preferred, preferably rigid or semi-rigid plastic.

The surface of the base 10 comprises shaft seats, preferably in the form of apertures 50, into which the shafts/pegs 70 are inserted such that they are immobilized in an upright position. In order to immobilize the shaft/peg 70, the base 10 has a depth such that the length of the shaft/peg 70 which extends into the base 10 is laterally supported. In some embodiments, the base 10 comprises a slab of material of a substantially uniform thickness, dimensioned such that it can be lowered into the container, i.e., past the rim 30 of the container 40. For example, in some embodiments, the base 10 can have a thickness of about 0.5 to about 6.4 millimeters (mm), preferably about 1.6 to about 2.6 mm. The apertures 50 can extend partially or completely through the base 10. In an embodiment, the apertures 50 extend through the base 10 a distance that is at least the same as the height of the shaft/peg 70.

The present invention also includes situations in which the shafts/peg 70 are not of uniform diameter over their inserted height, i.e., the height of the shaft/peg 70 that is inserted into the base 10. In other embodiments, the shaft/peg 70 may taper, and even come to a point at the bottom end. The foregoing embodiments are discussed in further detail elsewhere herein. Thus, the aperture 50 may have a receptacle contour which complements the contour of the shaft/peg 70 along its inserted height. In other embodiments, the present invention encompasses other shaft/peg 70 designs in which the inserted portion of the shaft/peg 70 may have relatively shallow ribs, undulations or other projecting forms, such as, for example, projections extending parallel to or perpendicular to the axis of the shaft/peg 70, which aid in the seating of the shaft/peg 70 in the aperture 50. In such situations, the aperture 50 may be a constant diameter throughout its height, but the diameter of the inserted height of the shaft/peg 70 is not necessarily constant. However, in order to for the shaft/peg 70 to fittingly occupy the aperture 50 when inserted, if is preferred that the shaft/peg 70, once seated, has at least one area along its height at which the width/diameter of the shaft/peg 70 and the width/diameter of the aperture 50 are close enough in size that the shaft/peg 70 seats in the aperture 50 such that upon inverting the base 10, the shaft/peg 70 does not fall out of the aperture 50.

In general, the aperture 50 have dimensions such that they can removably receive the shaft/peg 70. As such, it is preferred that the apertures 50 are sized such that a user can easily slide the shaft/peg 70 into and out of the aperture 50 without using more than a normal amount of exertion. It should be noted that the present invention encompasses situations in which the cross sections of the shaft/peg 70, especially cross section of the inserted height, are not round, but are instead other shapes, such as obround (for example, oval) or polygonal. In some aspects, as described below, the cross-section is star-shaped. The above description with respect to the shaft/peg 70 fittingly occupying the aperture 50 is applicable to these non-round shapes as well. In exemplary embodiments, the shaft/peg 70 has a square, pentagonal, hexagonal or octagonal cross section, at least along its inserted height. In other embodiments, the inserted height has a different cross section that the upper portions of the shaft/peg 70 such than upon insertion into the aperture 50, the upper portion of the shaft/peg 70 is sterically prevented from entering the aperture 50. Overall, in a preferred embodiment, the relative dimensions of the shaft/peg 70 and aperture 50 are such that, as indicated above, the shaft/peg 70 does not readily fall out of the aperture 50 upon inversion of the base 10.

The diameter referred to herein has the normal definition in the case of circular cross sections, but in the case of non-circular cross sections, such as, for example, obround or polygonal cross sections, an equivalent diameter is taken, which is the widest dimension of the cross section. The relationship between the "maximum diameter" referred to above, and the "diameter" or "equivalent diameter" of the cross section is the following: the "maximum diameter" or "maximum equivalent diameter" is the maximum diameter or maximum equivalent diameter along the inserted height. "Diameter" or "equivalent" refers to the broadest width at a given point along the inserted height or at a given distance into the aperture 50. For a circular cross section, this is simply the diameter at a given distance along the inserted height or a given distance into the aperture 50 from the surface of the base 10. For a non-round inserted height or aperture 50, the diameter is instead an "equivalent diameter" which is simply the widest distance across the cross section (for example the major axis of an elliptical cross section, or the diagonal of a square cross section). In the case of star-shaped cross sections, the cross section will have an even number of sides. The widest distance is, in most cases, generally between two points. For example, if the cross section has an even number of points, the widest distance is between two diametrically opposed points. In some embodiments, the cross section is in the range of about 5.3 to about 53 centimeters (cm). In further embodiments, the cross section is in the range of about 0.36 to about 3.6 cm. In further embodiments, the cross section is in the range of about 0.5 to about 2 cm.

Figure 4:
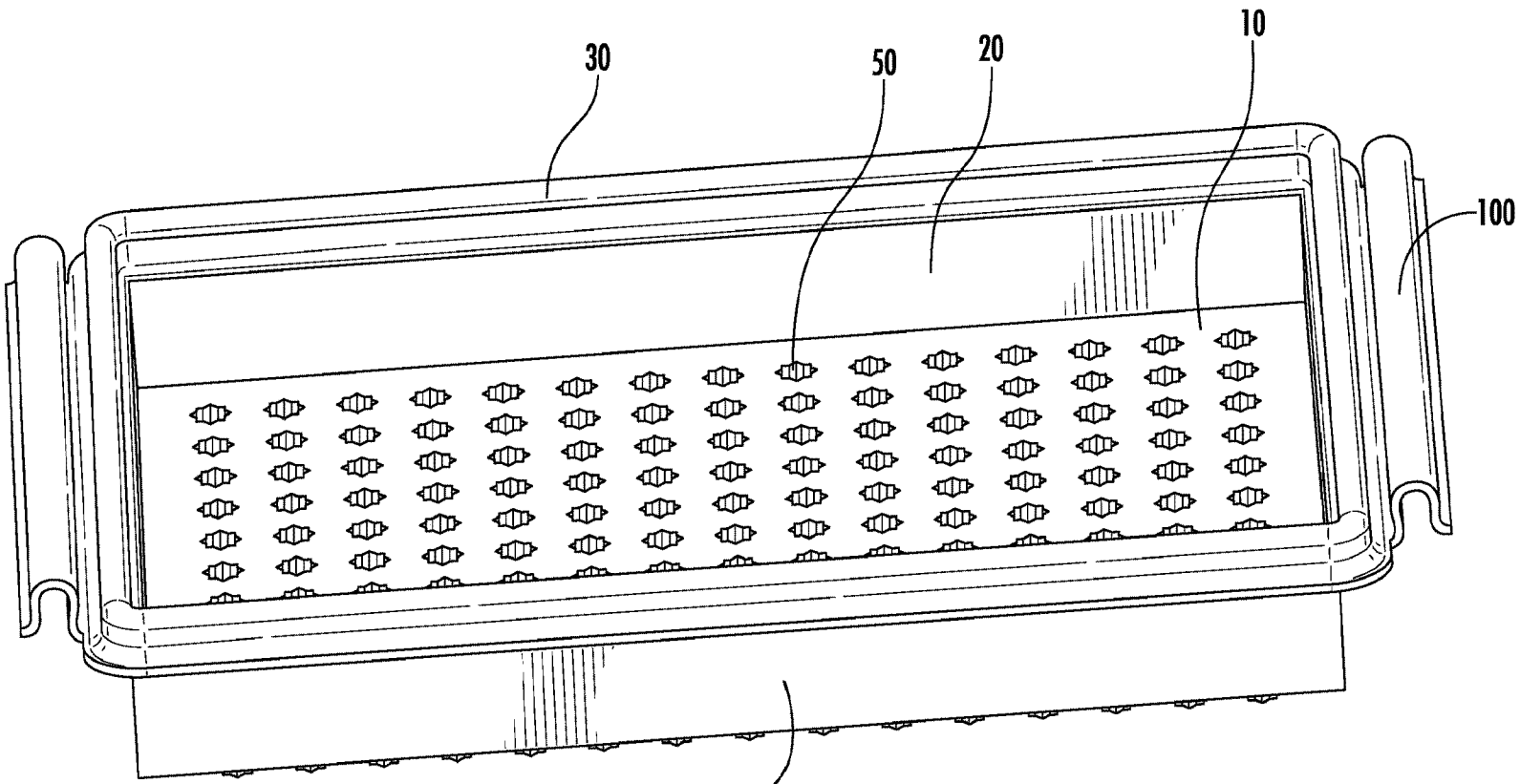
FIG. 4 depicts an offset view of walled base showing rim and star-shaped shaft seat with eight points.

In other embodiments, instead a substantially solid base 10, the base 10 can have a hollowed form, such as shown in FIGS. 1 and 4. In such a situation, the surface of the material comprises projections extending from the underside of the surface which serve to support the shafts in their upright positions. In comparison to the "solid" embodiment discussed above, with regard to the hollowed embodiment, enough base material is retained such that the aperture 50 is preserved. The hollowed base 10 can be manufactured in the same embodiments as the solid base 10 with regard to shaft/peg 70 and aperture 50 shape. Analogously, the aperture 50 can extend through the projection. In one aspect, the base 10 has a skirting projection extending from its border in such a way that it does not interfere with the insertion of the base 10 into the container 40. In another embodiment, such as depicted in FIGS. 1 and 4, the skirting is absent. In a preferred embodiment, the base 10 has a hollowed form and the skirting is absent.

The apertures 50 are arranged across the surface of the base 10. The arrangement can be regular, with the apertures 50 centered at the points on a Cartesian, cylindrical or radial grid, or other pattern. The arrangement can include two or more different size apertures 50. In one embodiment, the arrangement can be a regularly arrange combination of two or more shaft/peg 70 sizes. In another embodiment, the arrangement can comprise two or more different shaft/peg 70 sizes with a given shaft/peg 70 size predominating, in some aspects, exclusively, in a given area of the base 10. In preferred aspects, the apertures 50 on the base 10 are all of the same size and type, and they are arranged such that each aperture 50 is centered around a hypothetical two dimensional Cartesian grid overlay, for example, see FIGS. 1-4.

The apertures 50 can be molded during the formation of the base 10 or fashioned afterward by means such as punching. In some embodiments, the base 10 is made with removable sections, which once removed, give rise to an aperture in the base 10. The base 10 can be manufactured such that the removable sections are temporarily attached, such as with partial connections which can be severed or broken by the user with minimal pressure. Examples of such partial connections include partial scores, dotted partial or complete scores, and the like. In one embodiment, the removable sections are located in a regular arrangement across the surface of the base. All or a select subset of the sections can be removed to give a desired arrangement of apertures.

The compartmentalization assembly 1 further comprises one or more separators 60. Each separator 60 comprises one panel and one or more shafts/pegs 70. In a preferred embodiment, each separator 60 comprises one shaft/peg 70. The shaft/peg 70 comprises an inserted height, discussed above, which is the height of shaft/peg 70 inserted into the aperture 50. At least a portion of the shaft/peg 70 is connected to a panel and, in use, the shaft/peg 70 is inserted into a aperture 50 such that the panel is supported in an upright position. The uprightly oriented panels can be repositioned by removing the shaft/peg 70 from the aperture 50 it occupies, and reinserting into aperture 50 at a different position in the grid. In embodiments having round, polygonal, or otherwise symmetric cross sections, a further degree of positioning, i.e., orientational adjustment, can be realized by removal of the shaft/peg 70 and reinsertion into the aperture 50 such that the panel has a different orientation. Thus, a shaft/peg 70 and aperture 50 having a round cross section offers a continuous 360 degree orientation potential of the attached panel, in other examples, hexagonal and octagonal shafts/pegs 70 and apertures 50 give the potential for six and eight different orientations, respectively.

For a given compartmentalization assembly 1 comprising a base 10 and separators 60, the dimensions of the panels depend upon the use to which the compartmentalized container 40 is put. In general the compartmentalization assembly 1 and method described herein can be used in a wide range of containers 40, and thus, the separators 60, base and container 40 can be of a wide variety of absolute dimensions. For example, the container 40 may be used to separately store articles as small or smaller than various sizes and types of ball bearings or buck shot; articles of medium size, such as fittings, screws, washers, etc.; intermediately sized items such as fishing lures and floats, ammunition, fittings; larger items such glasses or silver ware; and even larger or much larger items.

The compartmentalization assembly 1 can be used with a wide range of embodiments. The compartmentalization assembly 1, including base 10 and separators 60, may comprise two or more differently dimensioned separators 60, such as, for example, two or more different widths.

In some embodiments, the compartmentalization assembly 1 is a relatively small embodiment, such as, for example a cosmetic case or organizer for relatively small items Accordingly, in some embodiments, the assembly 1 comprises one or more panels, each having a length in the angle of about 1.2 to about 4 cm and a height in the range of from about 2.5 to about 25 cm. In another embodiment the assembly 1 comprises one or more panels, each having a length in the range of about 2.5 to about 25 cm and a height in the range of from about 1.2 to about 4 cm.

In some embodiments, the compartmentalization assembly 1 is a relatively large embodiment, such as, for example a storage bin or organizer for relatively large items. Accordingly, in some embodiments, the assembly 1 comprises one or more panels, each having a length in the range of about 1.2 to about 10.2 cm and a height in the range of from about 2.5 to about 25 cm. In another embodiment, the assembly 1 comprises one o more panels, each having a length in the range of about 2.5 to about 25 cm and a height in the range of from about 1.2 to about 4 cm. In other embodiments, the ratio of the height to the width of the panels is in the range of about 1:10 to about 3:1 with a ratio in the range of about 1:4 to about 1:1 preferred. In other embodiments, the compartmentalization assembly 1 comprises two or more differently dimensioned panels. In further embodiments, the assembly 1 comprises three, two, or one differently dimensioned panels.

The panels are essentially two dimensional, having a thickness as required to give a sturdiness to the separator 60. As with the base 10, one or snore of a variety of materials can be used to form the panel, such as, for example, plastic (for example, polymeric); ceramic, wood or metal. Plastic materials are preferred. The panels may have a profile which varies in dimension with the height. For example, it may be convenient, for greater sturdiness, for the part of the panel closest to the base to be broad, tapering to the part of the panel most remote from the base. In one embodiment, the profile tapers from close to remote. In another embodiment, the profile is widest at the top, or at a position intermediate the close and remote limits. In other embodiments, the panel is of constant thickness throughout its surface area. For ease of cutting from a base sheet, such a panel is preferred. In additional embodiments, the profile has a maximum thickness in the range of about 0.26 to about 2.6 cm.

While it is generally contemplated that the panels are flat, they can be curved or undulating. While it is generally contemplated that the panels are rectangular, the scope of the present invention includes situations in which the panels have specialized shapes. For example, a separator 60 which comes into proximity of the walls of the container 40 can take the shape of the wall in order to form a separation which is not easily circumvented. For example, the container 40 can have walls which slope outward from the container base, which could require a separator 60 in which the close region is shorter than the remote region. One of skill in the art will recognize that the shapes of the separators 60 can be specialized to the shape of the container 40, or to the shape of the compartments required by the desired application.

Figure 15:
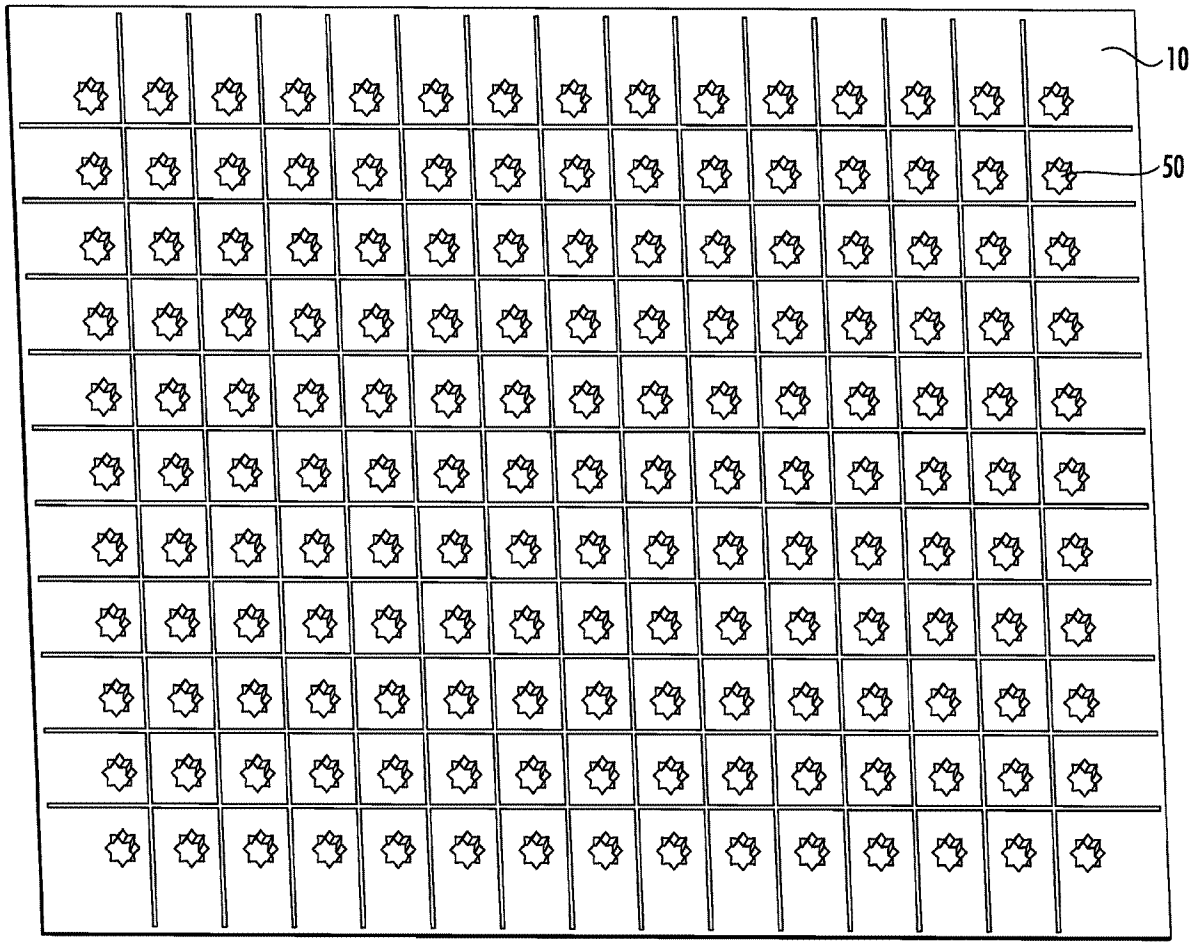
FIG. 15 depicts a scored base in which the dimension of the scores is the same as the distances between the shaft seat centers.
Figure 16:
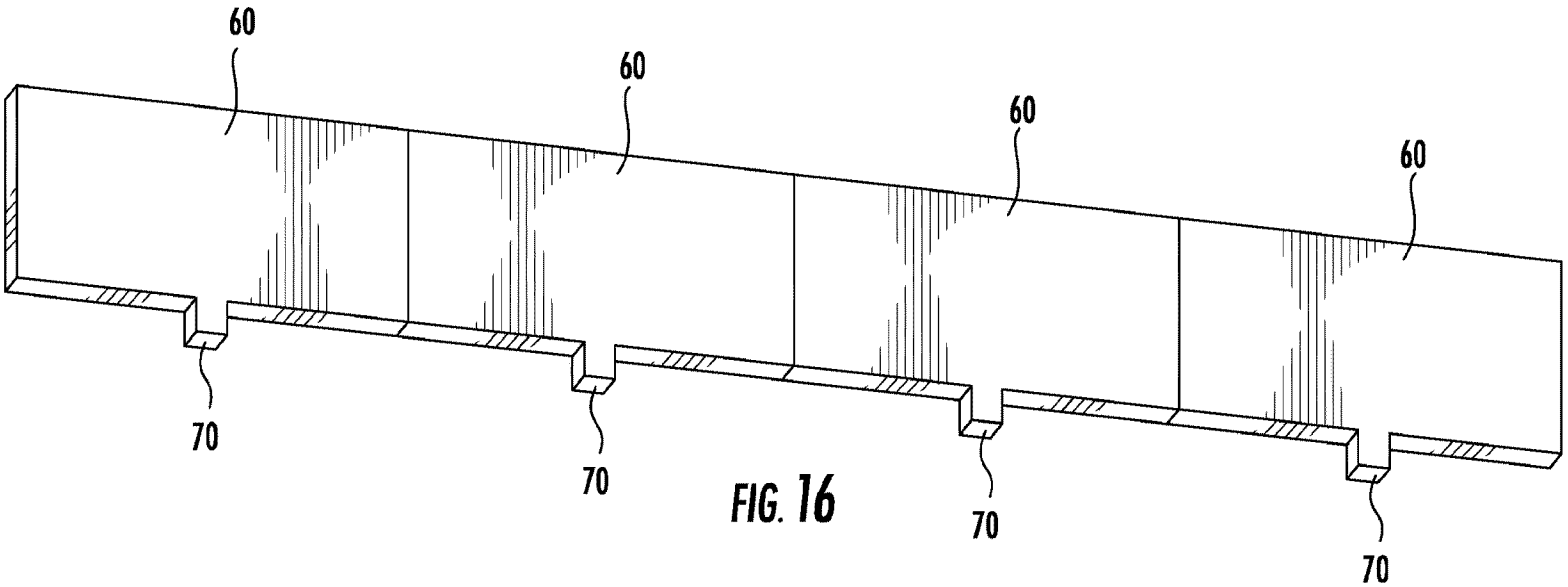
FIG. 16 depicts a vertically scored panel in which the width of the panel can be shortened by removal of discrete units, where each unit comprises a shaft.
Figure 17:
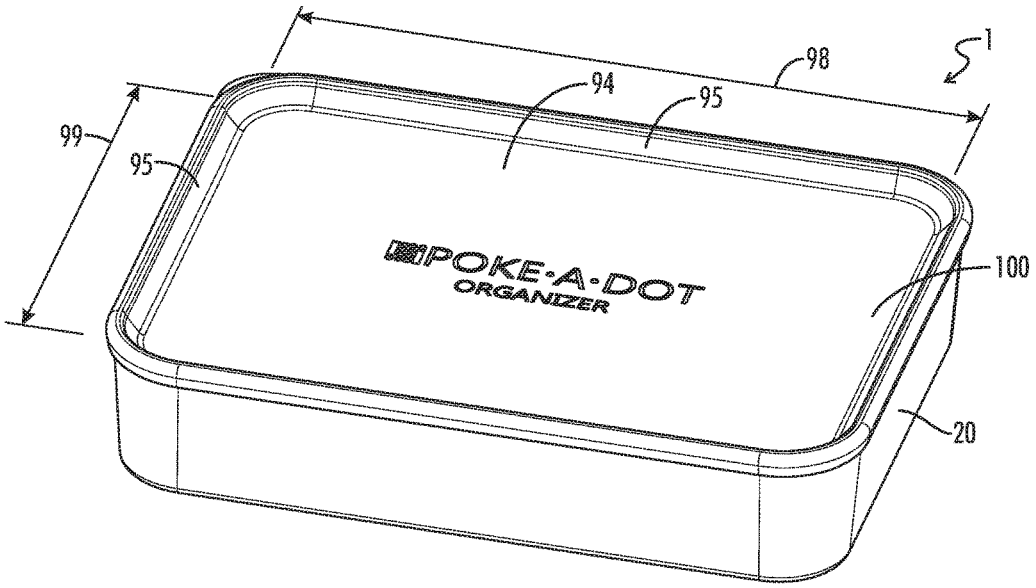
FIG. 17 depicts a side perspective view of a compartmentalization assembly of another embodiment of the present invention.
Figure 18:
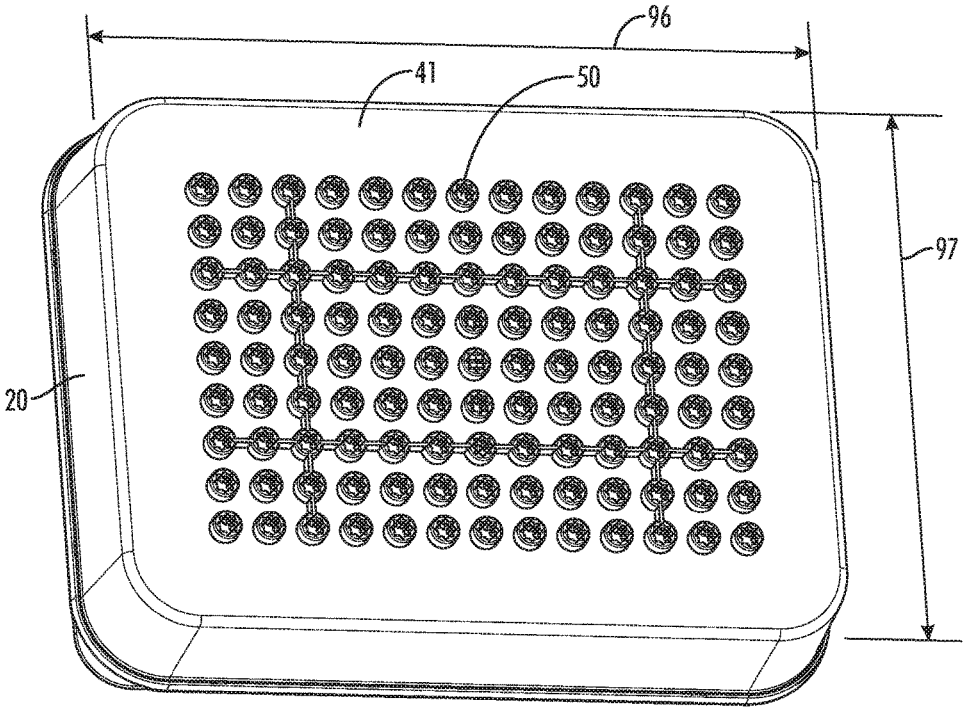
FIG. 18 depicts a bottom perspective view of the compartmentalization assembly of FIG. 17.
Figure 19:
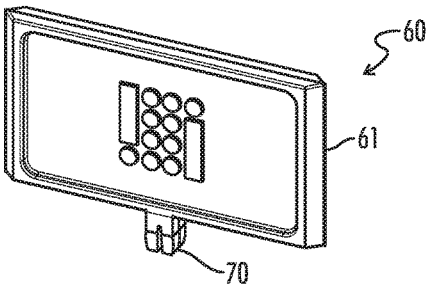
FIG. 19 depicts a side perspective view of a separator of the compartmentalization assembly of FIG. 17.
Figure 20:
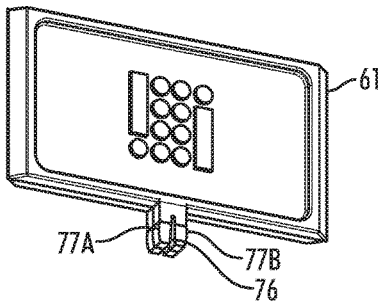
FIG. 20 depicts a side perspective view of a separator of the compartmentalization assembly of FIG. 17.
Figure 21:
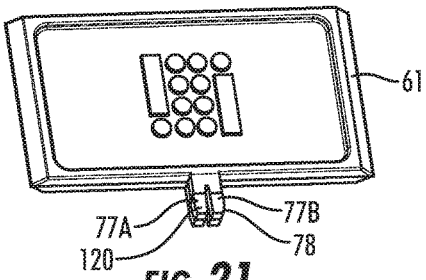
FIG. 21 depicts a bottom perspective view of a separator of the compartmentalization assembly of FIG. 17.

It is particularly convenient to fabricate the separators 60, comprising a shaft/peg 70 which is integral with a panel, from a sheet of material (a "base sheet"), preferably with uniform thickness. The parts can simply be cut out of the sheet using a die or other cutting method. This eliminates the need for a mold or other forming apparatus. In preferred embodiments, the cuts are perpendicular to the surface of the sheet. It is particularly convenient to cut the separators 60 from adjacent positions on the sheet such that they share at least a portion of at least one edge. As shown in FIG. 15, the adjacent positions can be such that one edge is shared (i.e., a side edge of each adjacent separator). Note that more than one edge can be shared. For example, part of the lower panel edge of one separator 60 can be shared with the upper panel edge of a second panel. In a further embodiment, the separators 60 are arranged such that an upper corner of a first separator shares a shaft/panel vertex of a second separator. In another embodiment, the first separator is inverted with respect to a second separator, and each separator 60 shares a shaft/peg side of the other separator, and a lower edge of each separator 60. While such a method can be used in such a way that material waste is greatly reduced or eliminated, it has other advantages as well. For example, if the width of the shaft/peg 70, as measured across the surface of the material sheet, is equal to the thickness of the material sheet, the shaft/peg 70 is of square cross section, which does not need to be shaped or processed further in order to be suitable for use in the present invention. In general, regular polygonal shaft cross sections can be used with certain aperture 50 embodiments in order to reduce the manufacturing cost of the compartmentalization assembly. As illustrated in the Figures, the aperture 50 can be star-shaped such that it seats a shaft/peg 70 in orientations of a number which is a multiple of the number of sides on the shaft/peg 70. In general, for a shaft of n-sides, the aperture 50 cross section must have a number of points which is an integral multiple of n, i.e., 1n, 2n, 3n, etc. Such a aperture 50 will seat the shaft/peg 70 in a number or orientations which is equal to the number of "points" on the star. It is preferred that the angle subtended by the two sides forming the point of the star is equal to the angle of the regular polygonal shaft cross section. In such a situation, the aperture 50 contacts the shaft/peg 70 over relatively large areas which is expected increase the security of the seating. Such a situation is illustrated in the Figures. However, within the scope of the present invention are situations in which the aperture 50 angle is greater than the regular polygonal angle. In such a situation, the number of orientations is the same as with the equality case, but the inner ribs of the aperture 50 (corresponding to the inward facing points of the aperture cross section) contact the shaft sides at discrete points around the circumference of the aperture 50, which can be less stable than the equality case. Alternatively, encompassed by the present invention are situations in which the aperture angle is less than the regular polygonal angle. In such a situation, the number of orientations is also the same as with the equality case, but the outer points of the aperture (corresponding to the outward-facing points of the aperture cross section) contact the shaft/peg 70 at discrete star points around the circumference of the aperture 50, which can be less stable than the equality case. In some embodiments, the cross section of the shaft/peg 70 is a regular polygon wherein n is an integer and is in the range of three to eight (i.e., having three to eight sides), and more preferably in the range of four to six sides. The aperture 50 corresponding to the foregoing shaft/peg 70 is a star having in the range of n to 5n points (again, n is an integer), more preferably in the range of 2 to 4 points. In further embodiments the angle subtended by the two sides forming the outward-facing point of the star is equal to the angle of the regular polygonal shaft cross section. In a further embodiment, the shaft/peg 70 has a square cross section, the aperture 50 corresponding to the square shaft/peg 70 is a star having eight, twelve or sixteen points, and the angle subtended by the sides comprising a point of the star is about ninety degrees.

It should be noted that the present invention encompasses situations in which the aperture 50 has a regular polygonal cross section of n sides and the shaft/peg 70 has a cross section which is a star with n points. However, the manufacturing advantage explained infra is generally not realized such a situation because the shaft/peg 70 must be further machined such that it has a star-shaped cross section.

A base sheet from which the apertures 50 are cut can be prepared by standard methods known in the art, such as, for example, thermoforming or vacuum forming. For example, a plastic sheet can be formed into a base sheet heated to a pliable forming temperature, formed to a desired shape and thickness, by being stretched over or into a mold, if need be, and trimmed, if need be, to create the base sheet.

Thus, the advantages of cutting the separators 60 out of a sheet of material rather than forming them with other methods (such as, for example, separate fabrication of panel and shaft) include 1) reduction in material waste, and 2) the avoidance of extra shaft shaping/machining. With respect to the latter, no separator orientational flexibility is lost because the apertures 50 are designed to securely hold the four-sided shaft/peg 70 in a number of orientations which can be a multiple of four, or 4 n. This is an advantage because it is generally easier to punch an aperture 50 having a specific shape than it is to further machine additional sides or features on a shaft/peg 70 after it has been released from a sheet or otherwise fabricated. In particular the specialized seat is useful for four-sided shafts of square cross section, which can conveniently be formed by cutting a separator from a sheet which is as thick as the width of the shaft/peg 70.

In one embodiment, the compartmentalization assembly 1 comprises one or more walls 20 around the perimeter of the base 10, and, optionally a rim 30 on the upper edge of the walls. In such an embodiment, the base 10 can be completely enclosed by walls 20 such as shown in the Figures. The base 10 can be set into the container 40, with a rim 30 which, optionally, contacts the edges of the container walls 20. the Figures depict a base 10 enclosed by walls 20 which bear a rim 30. In the depicted embodiment, the rim 30 does not touch the edges of the walls 20.

If a lid 90 is desired on the container 40 to be compartmentalized, it is preferable that the panels, in use, not prevent the application or closing of the lid 90. Thus, if the panels, in use, project above the rim 30 of the container 40 being compartmentalized and a lid 90 is desired, the lid 90 is preferably dome-shaped, such that the lid edges can meet the container edges without interfering with the separators 60 as they are positioned on the base 10. Furthermore, if the closed container 40 is to remain compartmentalized, with the contents of the respective compartments unmixed, it is preferred that the lid 90, in use, come dose enough to the tops of the separators 60 that the contents of the compartments are not mixed. Note that in some cases, it may not be necessary for the separator 60 to extend all the way to the surface of the base 10 or all the way to the lid 90. For example, relatively large objects such as, for example, marbles as opposed to ball bearings, have a larger tolerance.

The compartmentalization assembly 1 is used to compartmentalize a container 40. The container 40 has been discussed hereinabove in detail. The container 40 comprises a support panel and sidewalls. The compartmentalization assembly 1 fits into the container 40. In one embodiment, the method comprises the use of a compartmentalization assembly comprising: a base 10 which comprises a surface, said base 10 comprising apertures 50; at least one separator 60, said separator 60 comprising a panel and one or more shafts 70, each of which extends in the plane of or parallel to the plane of the panel, wherein each of said one or more shafts 70 is characterized by a cross section shaped such that each of the shafts 70 can each be fittingly received into one of said apertures 50.

In one embodiment, the compartmentalization assembly 1 in use, rests on the base 10 of the container 40. In other embodiments, the base of the compartmentalization assembly 1 is positionally secured in the container 40 by resting on formations located on the sides of the container 40. In other embodiments, the compartmentalization assembly 1 comprises walls 10 and a rim 30, and the securing is accomplished by the rim 30 of the compartmentalization assembly 1 resting on the rim 30 of the container 40. In either embodiment, the compartmentalization assembly 1 can be suspended above the surface panel of the container.

In yet another embodiment, the base 10 additionally comprises score lines which are positioned such that the base can be sized by breaking off excess material as desired. In one embodiment, the scores are present as a Cartesian grid (See FIG. 15) Other scores, such as off-axis Cartesian grids (i.e., in which the axes are at an angle other than 90 degrees), radial, concentric circular, and the like are encompassed by he present invention. It can be particularly convenient to implement the score lines such that each removable piece contains a single aperture 50. For example as illustrated in FIG. 15 in the Cartesian grid embodiment, the aperture 50 arrangement has the same dimensions as the score line arrangement, and is offset with respect to the score lines such that each removable piece comprises an aperture 50. Many other arrangements are possible. For example the apertures 50 and score lines may be dimensioned and positioned such that two or more apertures 50 are contained in each removable piece. In alternative arrangements, each removable piece can contain, on average, less than one aperture 50. In a preferred further embodiment, the base is made of HDPE (high density polyethylene), PP (polypropylene), PET (polyethylene terephthalate), or the like, such that the scores can be easily broken.

Figure 13:
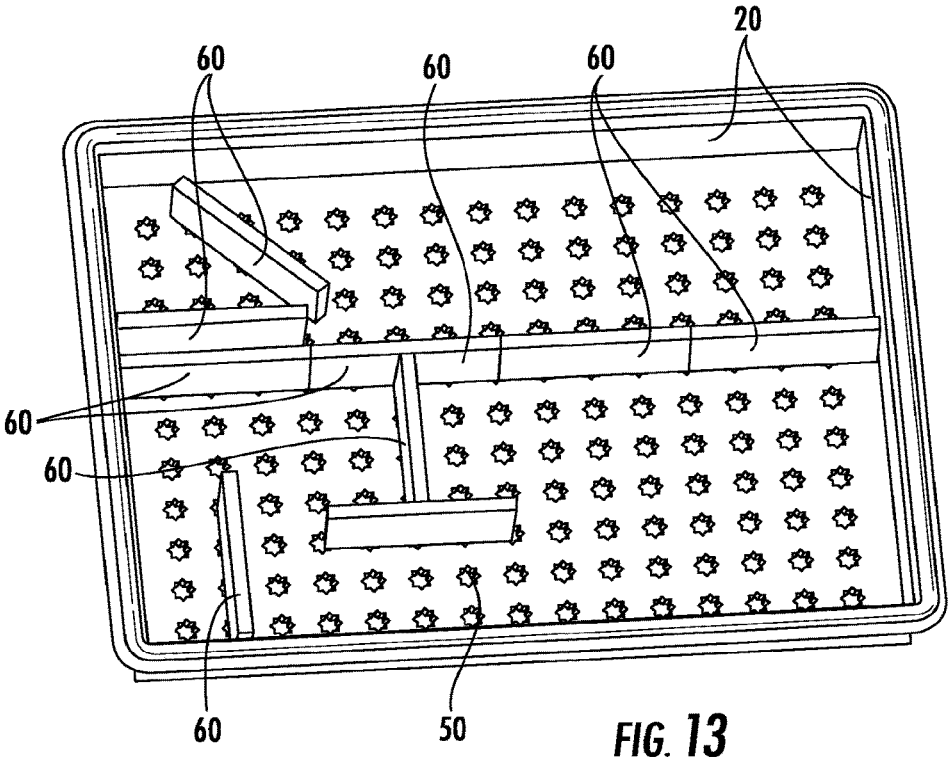
FIG. 13 depicts a walled base with separators showing 8-star-shaped shaft seats and diagonal orientation achievable with square shaft cross section.
Figure 14:
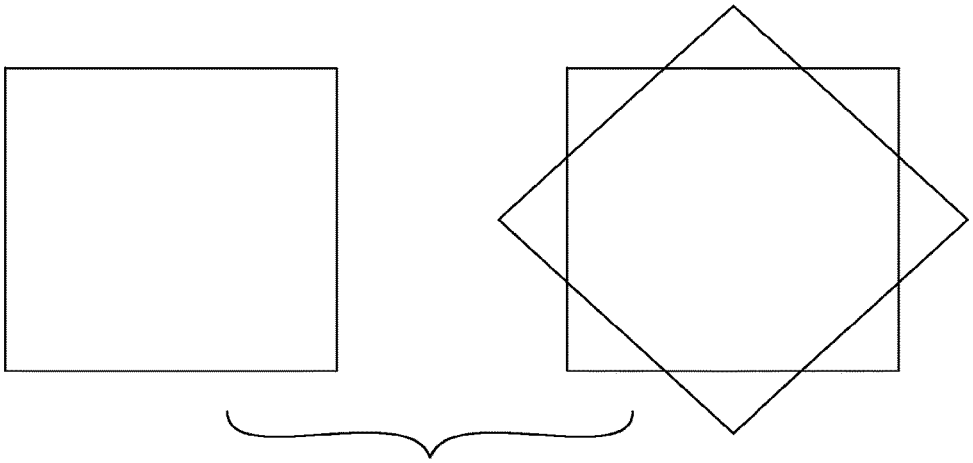
FIG. 14 depicts a graphical depiction of the orientational possibilities associated with a square cross section and an 8-star-shaped shaft seat

In yet another embodiment, the panel additionally comprises score lines which are positioned such that the panel can be sized by breaking off excess material as desired. In one embodiment, the scores are present as a Cartesian grid. In other embodiments, the score lines run vertically, allowing the width of the divider to be discretely adjusted downward. In one embodiment, the discrete lengths of panel each comprise a shaft/peg 70. See FIG. 16. In the illustrated embodiment, the vertical score lines enable the shortening of the panel width, and the removed unit pieces can fit between 2 parallel panels that are installed in the grid. Such a configuration is illustrated in FIG. 13. The width of the unit piece is equivalent to the distance between the centers of the apertures 50. In other embodiments, the unit piece is less than the distance between the apertures 50, such as i/n the width, where n is an integer, for example 1, 2 or 3. In a preferred further embodiment, the base is made of HDPE (high density polyethylene), PP (polypropylene), PET (polyethylene terephthalate), or the like, such that the scores can be easily broken.

The compartmentalization assembly 1 of the present invention can be used to compartmentalize a wide variety of containers, from those as large or larger than storage bins to those as small or smaller than cosmetic cases which fit in small purses.

Figure 1B:
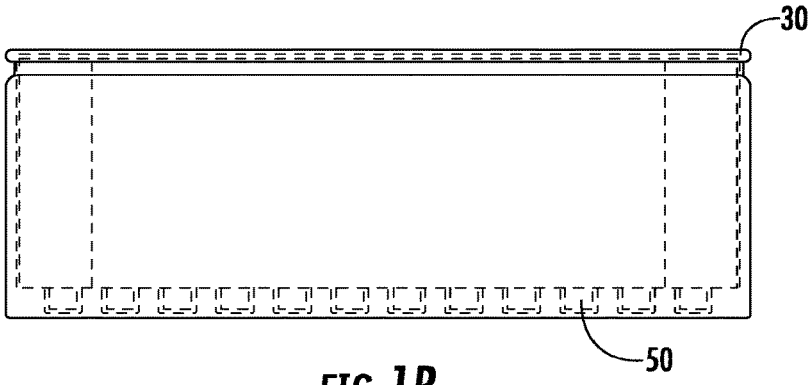
FIG. 1B depicts an end view of the walled base irremovably disposed inside a container shown in FIG. 1A.
Figure 2A:
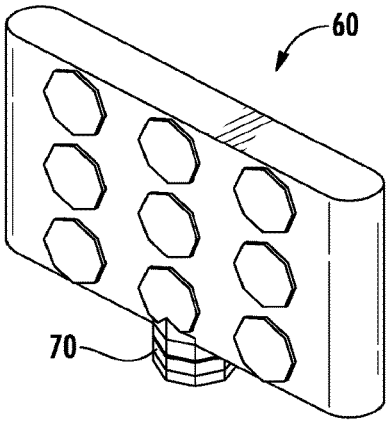
FIG. 2A depicts perspective view of a separator with an integral shaft and panel, with octagonal shaft and shaft gap for ease of insertion.
Figure 2B:
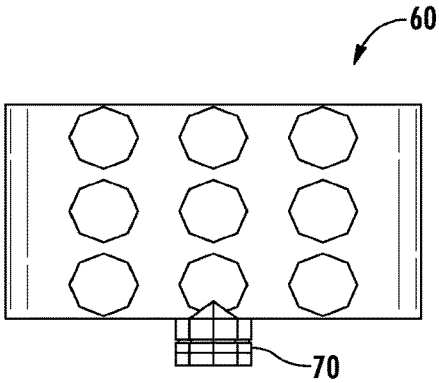
FIG. 2B depicts a front and rear view of the separator shown in FIG. 2A.
Figure 2C:
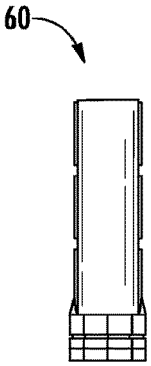
FIG. 2C depicts a side view of the separator shown in FIG. 2A.
Figure 2D:
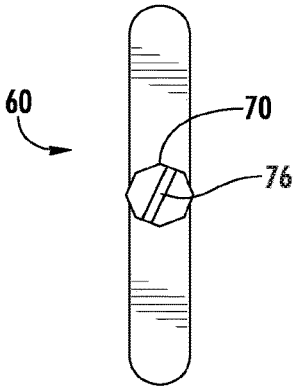
FIG. 2D depicts a bottom view of the separator shown in FIG. 2A.
Figure 2E:
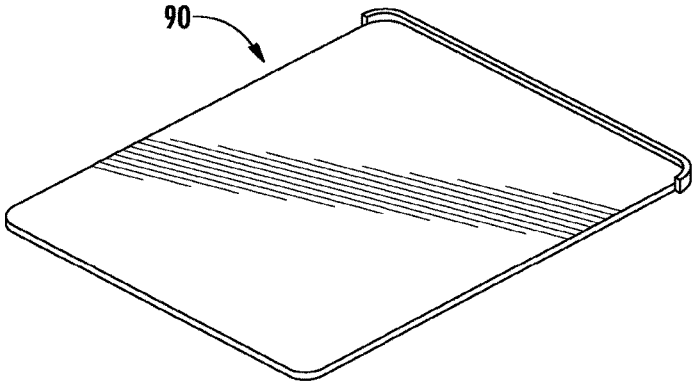
FIG. 2E depicts a perspective view of a lid.
Figure 2F:
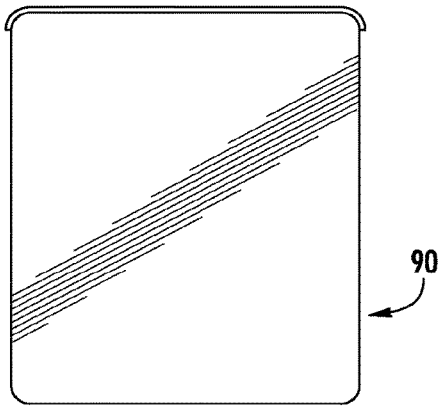
FIG. 2F depicts a top view of the lid shown in FIG. 2E.
Figure 2G:
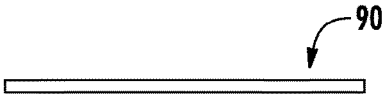
FIG. 2G depicts a side view of the lid shown in FIG. 2E.
Figure 2H:
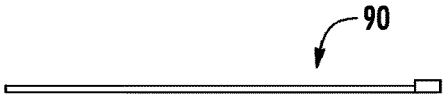
FIG. 2H depicts another side view of the lid shown in FIG. 2E.
Figure 3A:
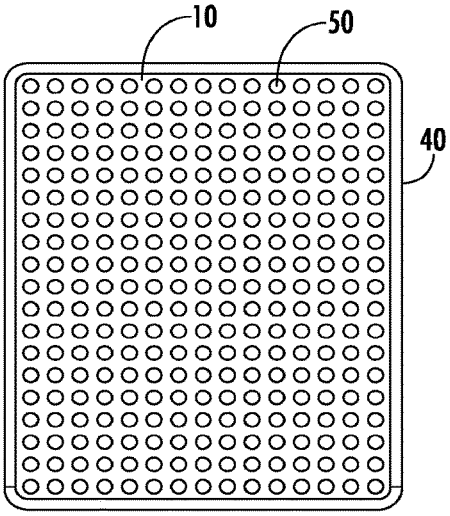
FIG. 3A depicts a top view of a walled base irremovably disposed inside a container with round shaft seats touching the floor of the container.
Figure 3B:
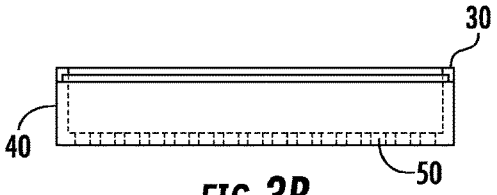
FIG. 3B depicts an end view of the walled base irremovably disposed in a container shown in FIG. 3A.
Figure 3C:
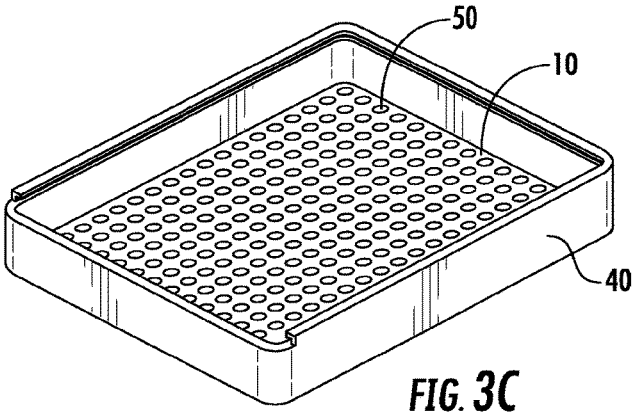
FIG. 3C depicts an offset top view of the walled base irremovably disposed in a container shown in FIG. 3A.
Figure 3D:
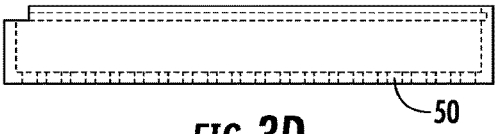
FIG. 3D depicts a side view showing a slot for a slidable lid of the walled base irremovably disposed in a container shown in FIG. 3A.
Figure 3E:
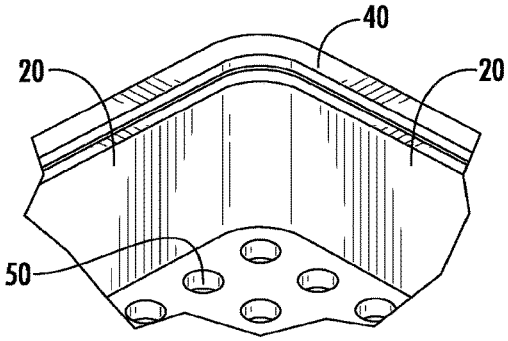
FIG. 3E depicts a close-up view of the corner of walled base irremovably disposed in a container shown in FIG. 3C.

The methods of forming the base 10 and separators 60 of the compartmentalization are not critical to the functionality of the assembly, but it is convenient to use polymeric materials such as HDPE, PP, LDPE and the like. Convenient methods of fabricating from such materials include cutting from stock sheets of material or other material bulk, thermoforming, extrusion, three dimensional printing, injection molding, compression molding, and the like. In a preferred embodiment, the separators 60 are conveniently cut from bulk material FIGS. 1A and 1B depict a base 10 comprising walls 20 and a rim 30 inside a container 40. The base 10 can be removable. In other embodiments, it is secured inside the container 40, such as, for example, with an adhesive. The depicted base 10 has apertures 50 which project from the underside of the base 10. In the depicted embodiment, the apertures 50 are round. The upper and lower figures are overhead and side perspectives, respectively.

FIGS. 2A-2D depict a separator 60 having an octagonal shaft/peg 70. The shaft/peg 70 embodiment depicted comprises a slot/split 76 which can, optionally, involve the removal of shaft/peg material to improve the ability of the shaft/peg 70 to fit removably in the aperture 50. Also depicted in FIGS. 2E-2H is a lid 90 embodiment which can be slid into a grooved base 10/container 40 assembly, such as, for example, into the rim 30 of a container 40 or the rim 30 of a walled base 10, the container 40 or base 10 having appropriate grooves for receiving the lid 90.

FIGS. 3A-3E depict a base 10/container 40 assembly which is integral. In one embodiment, the base 10 and container 40 can be fabricated by one piece extrusion of an integral base/container assembly. Also depicted is a grid distribution of polygonal apertures 50. In the depicted embodiment, the apertures 50 are tapered for easy shaft/peg 70 situation and removal.

FIG. 4 depicts a walled base 10 bearing a grid arrangement of star-shaped apertures 50. The rim 30 and walls 20 are clearly shown, as well as a handle 100 for easy removal of the walled base 10. The depicted star-shaped apertures 50 are intended to seat a shaft/peg 70 having a square cross section in eight different possible orientations.

Figure 5:
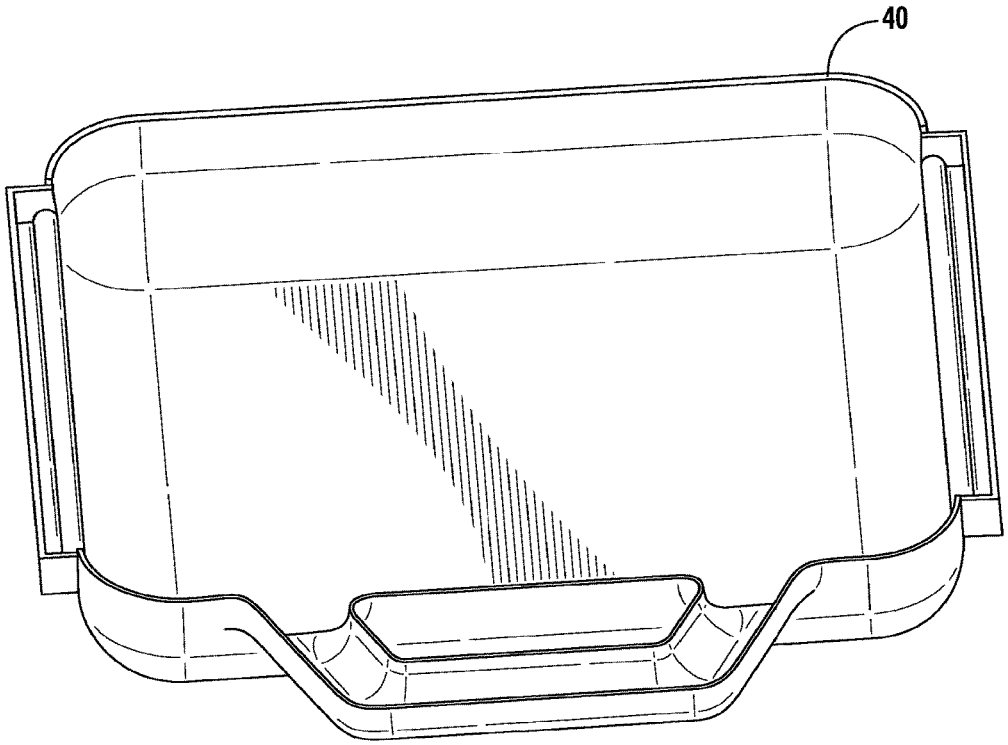
FIG. 5 depicts a walled container with rests for receiving a rim of a walled base.

FIG. 5 depicts a container 40 for receiving a base 10 such as that in FIG. 4.

Figure 6:
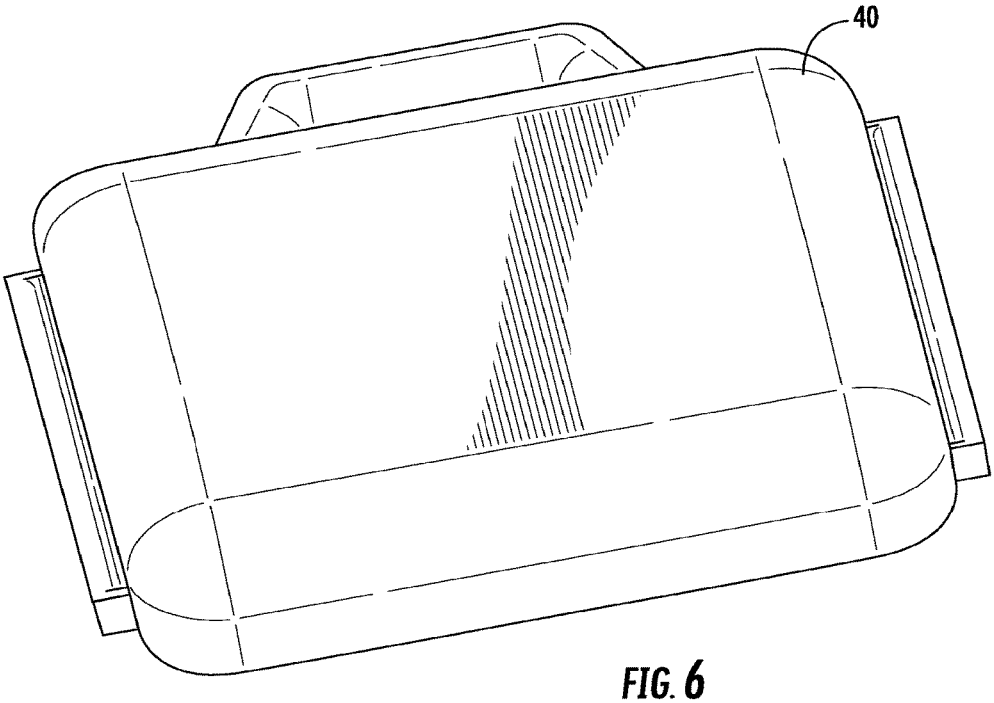
FIG. 6 depicts a bottom view of the container shown in FIG. 5.

FIG. 6 depicts a bottom view of the container 40 depicted in FIG. 5.

Figure 7:
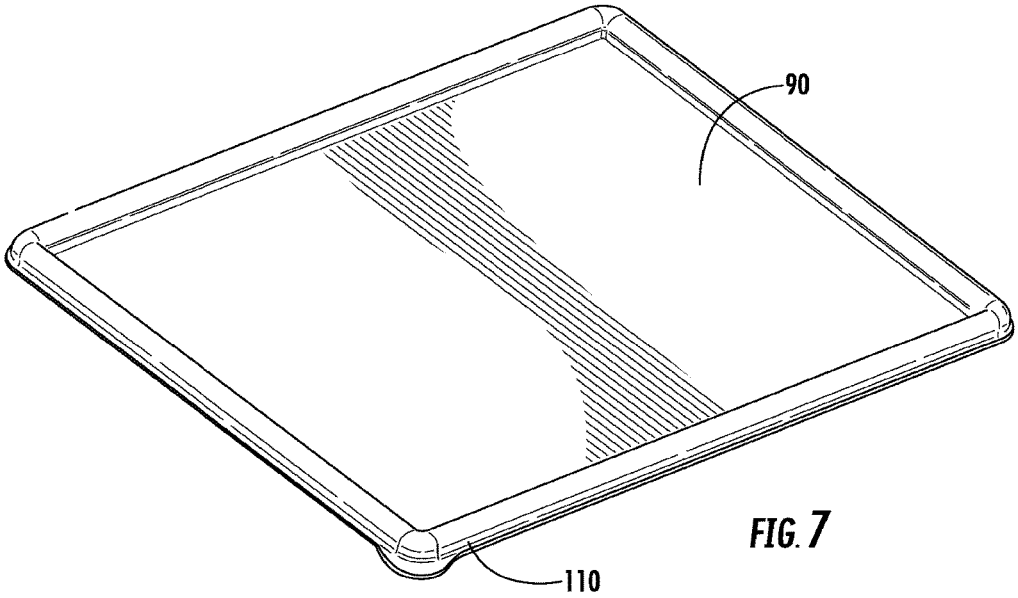
FIG. 7 depicts a top view of a lid with a border for receiving the rim of a walled base or of a container.

FIG. 7 depicts a lid 90 such as could be used with base 10/container 40 assembly. The depicted lid 90 has a portion 110 which can fit over the rim 30 of a walled base 10 or the rim 30 of a container 40 for a tight fit.

Figure 8:
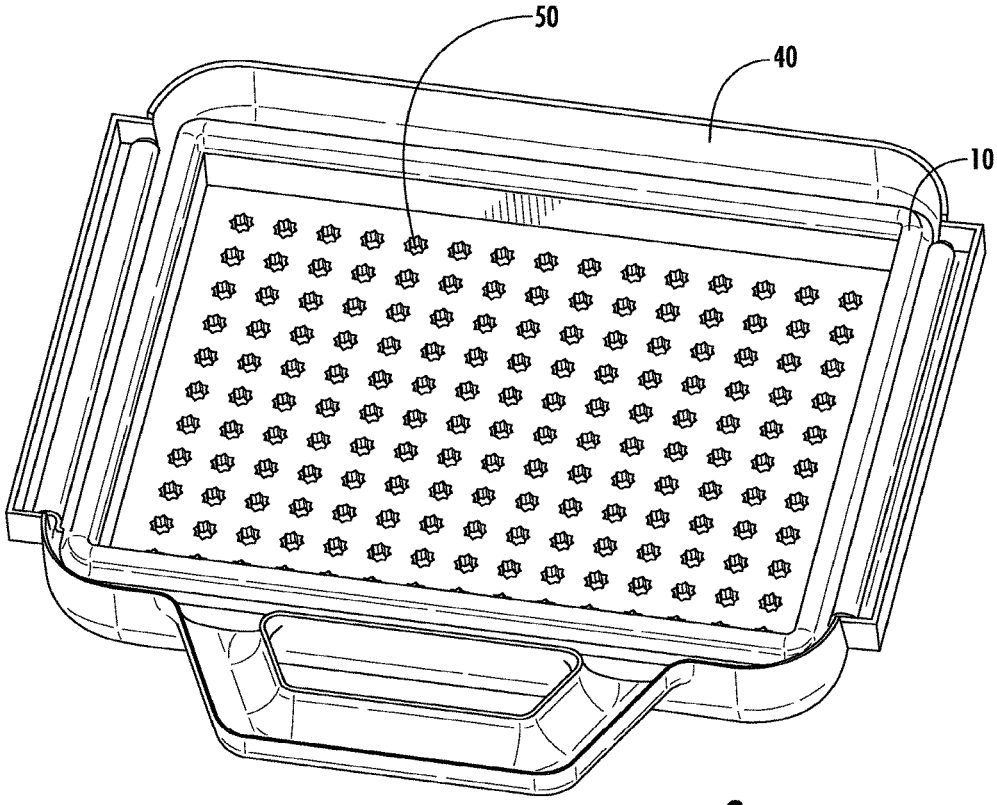
FIG. 8 depicts a walled base disposed inside of a container.

FIG. 8 depicts a wailed base 10 disposed within a container 40.

Figure 9:
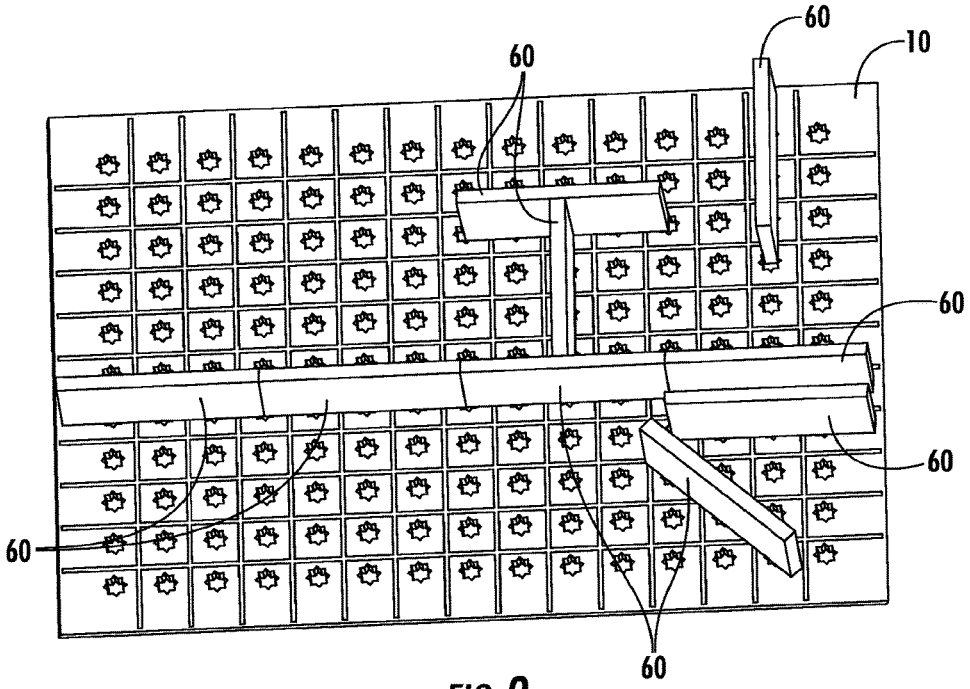
FIG. 9 depicts a base with separators showing 8-star-shaped shaft seats and diagonal orientation achievable with square shaft cross section.

FIG. 9 depicts a base 10 into which are disposed separators 60. While the shafts/pegs 70 are seated in the apertures 50 and thus not visible in the figure, the eight pointed star-shaped aperture 50 can seat a shaft/peg 70 with a square-shaped cross section with the flexibility of eight different orientations. Depicted are separators 60 disposed at 45 degree angles, a result obtainable due to the combination of star-shaped apertures 50 and polygonal shaft cross section.

Figure 10:
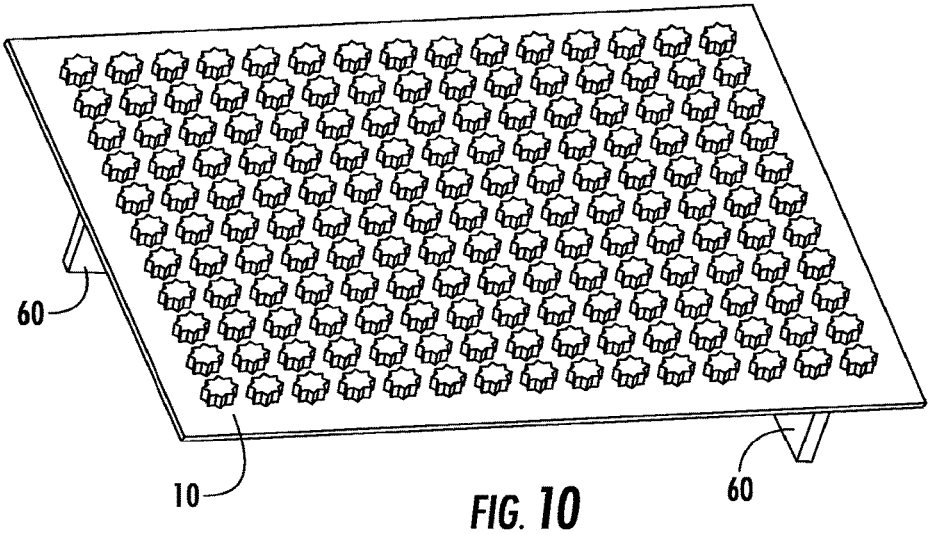
FIG. 10 depicts a bottom view of the base depicted in FIG. 9.

FIG. 10 depicts the bottom of the base 10 shown in FIG. 9. The apertures 50 extend from the bottom of the base 10.

Figure 11:
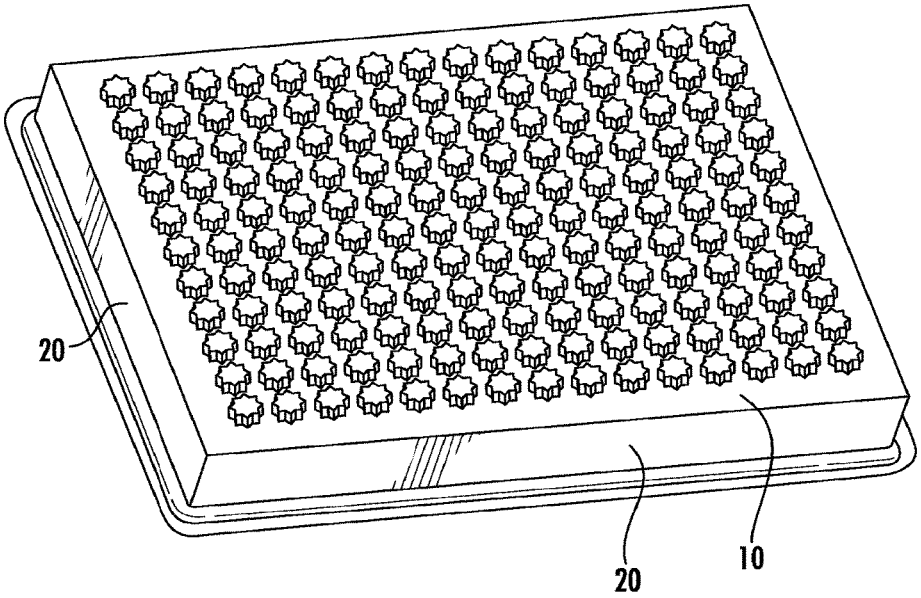
FIG. 11 depicts a bottom view of a walled base showing 8-star shaft seats.

FIG. 11 depicts a bottom view of a walled base 10 with a two dimensional Cartesian grid of eight-pointed, star-shaped apertures 50. The walled base includes a rim 30.

Figure 12:
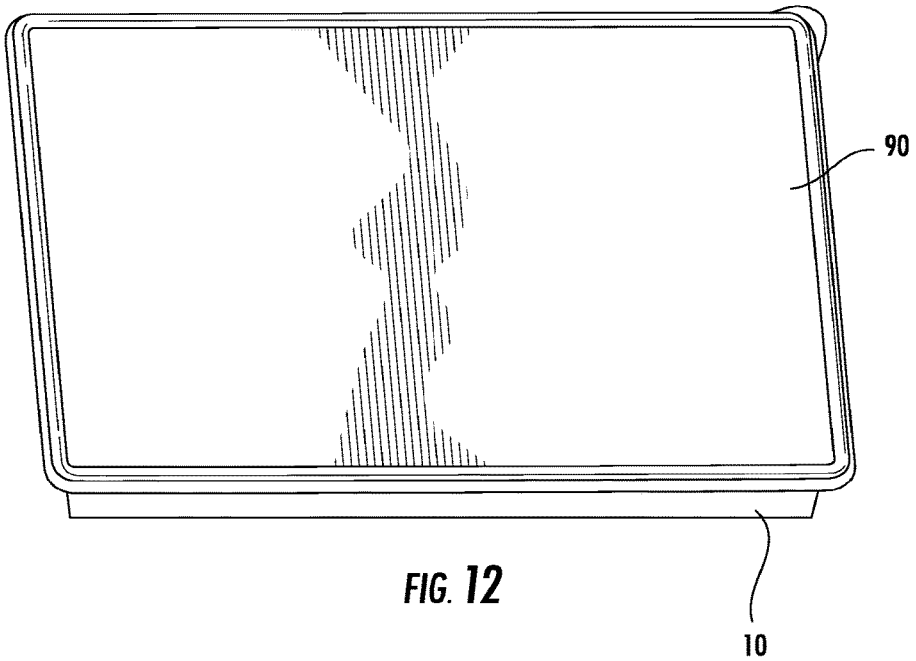
FIG. 12 depicts a lid functionally disposed on a container.

FIG. 12 depicts a lid 90 disposed on a base 10/container 40 assembly.

FIG. 13 depicts a walled base 10 with a two dimensional Cartesian grid of eight-pointed, star-shaped apertures 50, in which are disposed separators 60, one of which is at a 45 degree angle to another.

A base 10 or a walled base 10 can generally be conveniently prepared from polymeric materials as a single extruded or thermoformed piece. Alternatively, a walled base 10 can be prepared by augmenting a base 10 with walls 20 after the fabrication of the base 10. Both bases 10 and walled bases 10 are used, in the method of the present invention with containers 40. The base 10 or walled base 10 is inserted into the container 40. It can be secured within via methods known in the art. Alternatively, the base 10 or walled base 10 can be unsecured such that it can be lifted out of the container 40. However, the invention has a broader aspect than the use of a base 10 with a container 40. The invention also encompasses situations in which a container 40 has, integral to its structure, a bottom portion which bears a distribution of apertures 50. All other disclosure herein pertaining to base/container assemblies pertains as well to the situation in which the container 40 and apertures 50 are integral. Thus, a difference between the walled base 10 and the container with integral apertures 50 can be one of use: in use, the walled base 10 is nested into a container 40, whereas in use, the container 40 with integral apertures 50 is not. The walled base 10 may or may not be adapted to fit into a specific container 40. For example, the dimensions of the walled base 10 and container 40 can be such that upon lowering the walled base into the container 40, the walled base 10 has essentially no latitude to move in directions parallel to the bottom of the container 40. The walled base 10 may have tabs or formations which cooperate with complementary formations on the inside of the container to secure the base in the container. In one embodiment, the container 40 is of a polymeric or other non-rigid material, and it has tabs on its inner surface near its bottom surface such that during lowering the base 10 into the container 40, the tabs are temporarily displaced by the base 10, and locking back over the base 10 once it is fully positioned within the container 40.

In one embodiment, the base 10 is perforated, such as by a square grid of perforated lines through the thickness of the base 10 such that sections of the base 10 can be broken off, and the length and width of the base 10 can be altered by removing sections by breaking along the perforations. In another embodiment, instead of perforated lines, the lines are continuous partial scores through the thickness of the base 10. In yet another embodiment, the lines comprise discontinuous partial scores. In yet another embodiment, the lines comprise alternating discontinuous partial scores and perforations. In some non-limiting embodiments, the score lines in both dimensions are in the range of about 6.3 to about 80 mm apart. In other non-limiting embodiments, the score lines are in the range of 6.3 to about 80 mm apart in a first horizontal dimension, and in the range of about 6.3 to about 80 mm apart in the horizontal dimension perpendicular to the first horizontal dimension. The adjustable-sized base embodiment preferably is used with a base 10 having a thickness such that perforated sections can be easily removed, such as by breaking or cutting. In one embodiment, the thickness is less than about 1.5 mm.

In yet another embodiment, the separators 60 are perforated similarly as discussed for the base. For example, the panels can comprise a grid of perforated lines over its surface such that, similarly to the adjustable-sized base embodiment, sections can be broken or cut off such that the height and width of the separator can be adjusted. In some non-limiting embodiments, the score lines in both dimensions are in the range of about 2.6 to about 25.4 mm apart. In other non-limiting embodiments, the score lines are in the range of 2.6 to about 154 mm apart in the vertical dimension, and in the range of about 2.6 to about 25.4 mm apart in the horizontal dimension.

The Embodiments of FIGS. 17-38

FIGS. 17-38 illustrate an alternate embodiment of a compartmentalization assembly 1. In particular, in FIGS. 17-38, the compartmentalization assembly provides a shaft/peg 70 that includes a shaft slot/slit 76 and can be removably locked to a star-shaped aperture at various angles via a lock/press fit at various locations to create a variety of different-sized and differently-orientated compartments for storing cosmetics or other products.

Referring to further to FIGS. 17-38, the compartmentalization assembly 1 includes a base 10 comprising a plurality of shaft seats/apertures 50 and a plurality of separators 60. Preferably, each separator 60 comprises a panel 61 having a panel height 64, a panel length 65 generally perpendicular to the panel height 64, and a panel width 66 generally perpendicular to the panel height 64 and panel length 65, and a shaft/peg 70 extending generally downward from the panel bottom 63 and comprising a shaft/peg bottom 72, a shaft/peg top 71, a shaft/peg height 73 generally parallel to the panel height 64, a shaft/peg length 75 generally parallel to the panel length 65, and a shaft/peg width 74 generally parallel to the panel width 66. Preferably, each shaft/peg 70 further comprises a plurality of shaft/peg arms 77A and 77B (preferably two shaft/peg arms) and a shaft slot/slit 76 that preferably extends upward from the shaft/peg bottom 72 toward the shaft/peg top 71. The shaft slot/slit 76 preferably does not reach the shaft/peg top 71 as best seen in FIGS. 19-23. The shaft slot/slit 76 preferably separates the plurality of shaft/peg arms 77A and 77B. The shaft slot/slit 76 preferably extends from the peg/shaft front 120 to the peg/shaft rear 121 but not from the peg/shaft left side 122 to the peg/shaft right side 123—the shaft slot/slit 76 preferably extends widthwise 74 but not lengthwise 76 as best seen in FIG. 25. Optionally, the removable lock is a sufficient strength such that inversion of the compartmentalization assembly 1 does not cause peg/shafts 70 to fall out of apertures 50.

The compartmentalization assembly of FIGS. 17-38 may have any of the features of the compartmentalization assembly of FIGS. 1-16.

Figure 29:
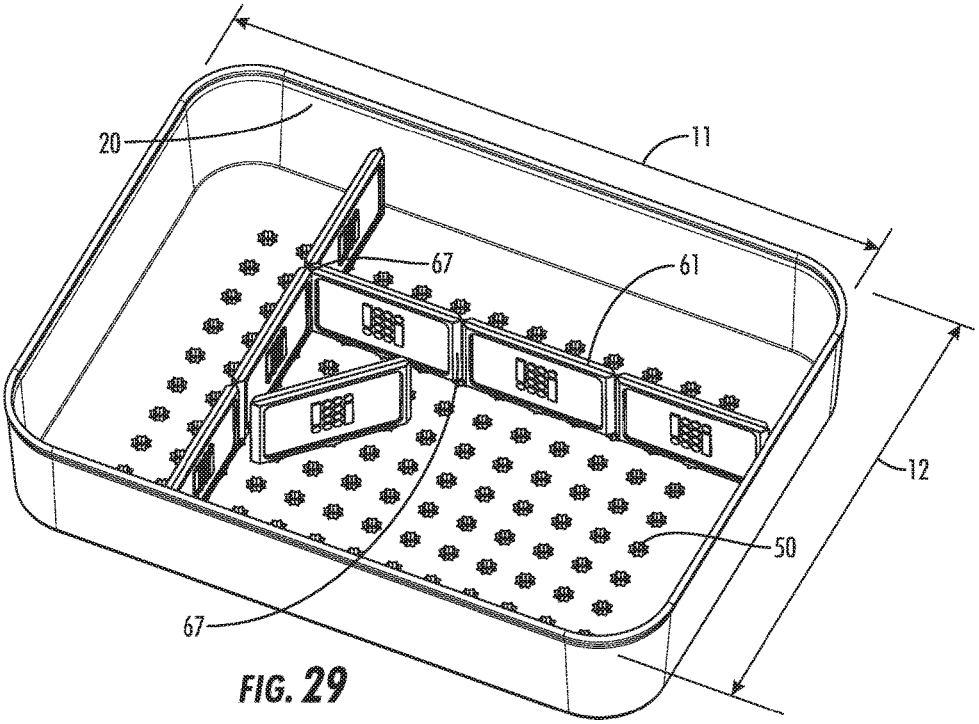
FIG. 29 depicts a top perspective view of the compartmentalization assembly of FIG. 17 without the lid.
Figure 30:
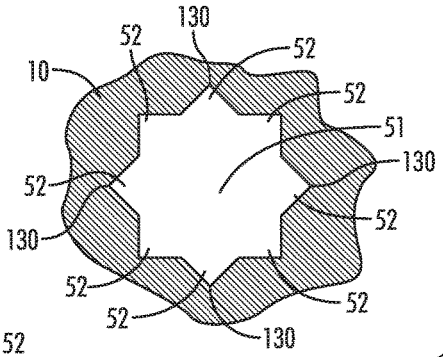
FIG. 30 is a top cross-sectional view of an aperture of the compartmentalization assembly of FIG. 17.
Figure 31:
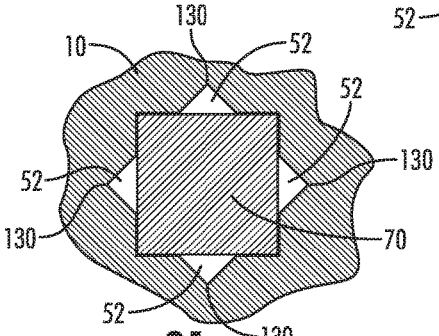
FIG. 31 is a top cross-sectional view of a peg of the compartmentalization assembly of FIG. 17 inserted into an aperture at a first angle.
Figure 32:
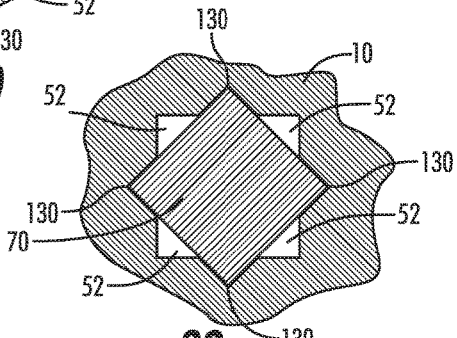
FIG. 32 is a top cross-sectional view of a peg of the compartmentalization assembly of FIG. 17 inserted into an aperture at a second angle.
Figure 33:
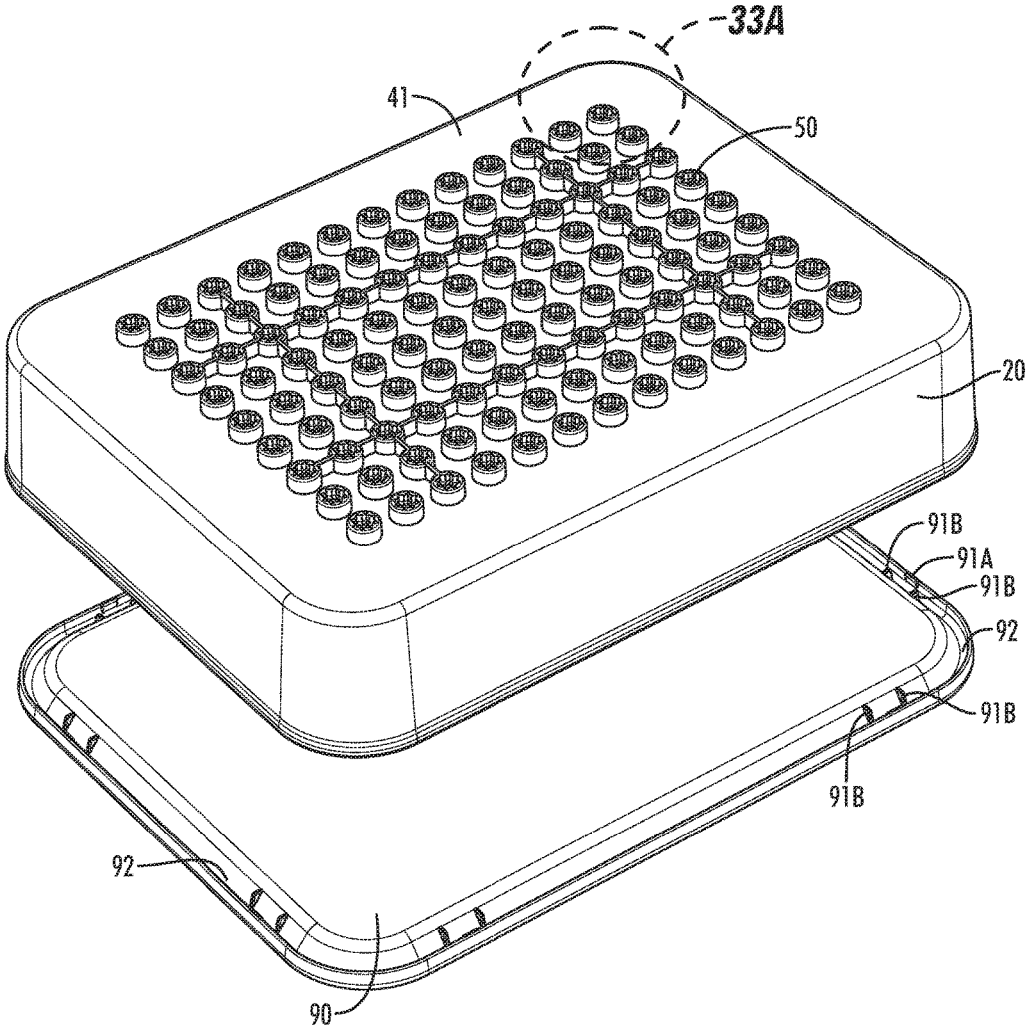
FIG. 33 depicts a partially exploded perspective view of the bottom of the compartmentalization assembly of FIG. 17.
Figure 33A:
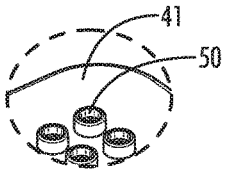
FIG. 33A depicts an alternate embodiment of the compartmentalization assembly of FIG. 17 in which the bottom portion of the aperture is cylindrical.
Figure 34:
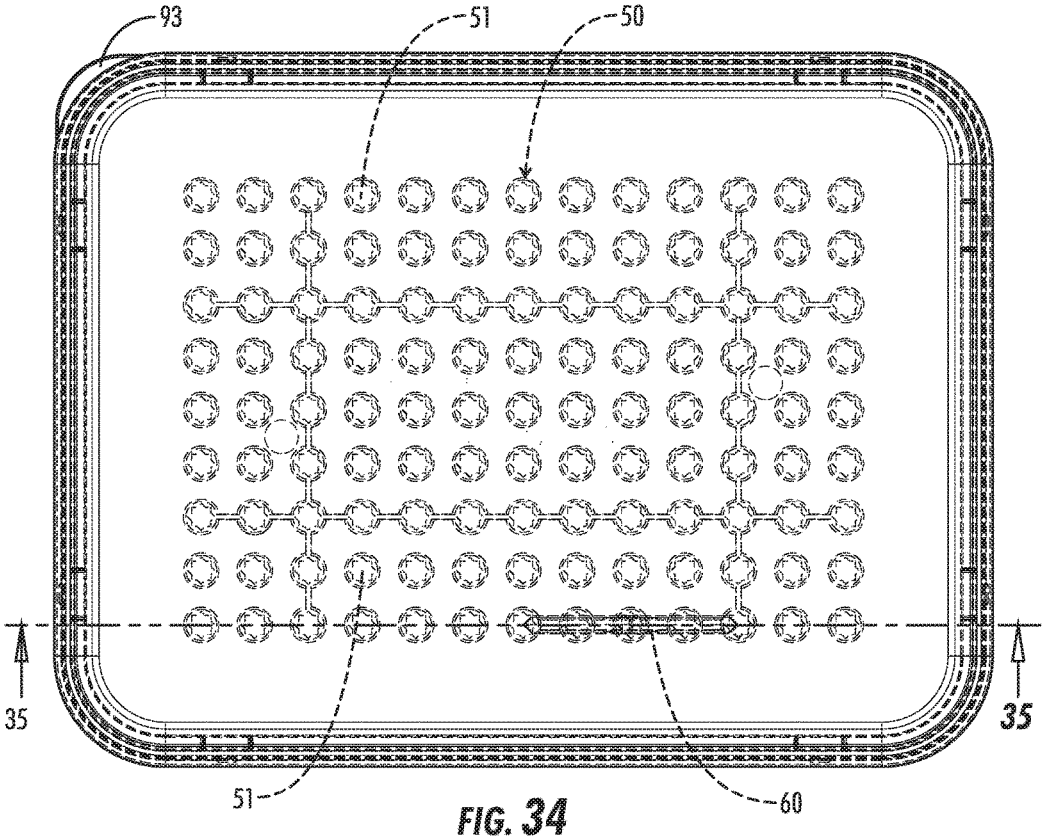
FIG. 34 depicts a bottom plan view of the compartmentalization assembly of FIG. 17.
Figure 37:
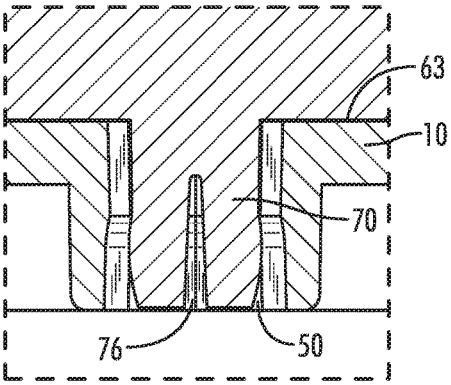
FIG. 37 depicts a side view of the area circled 37 in FIG. 35.
Figure 38:
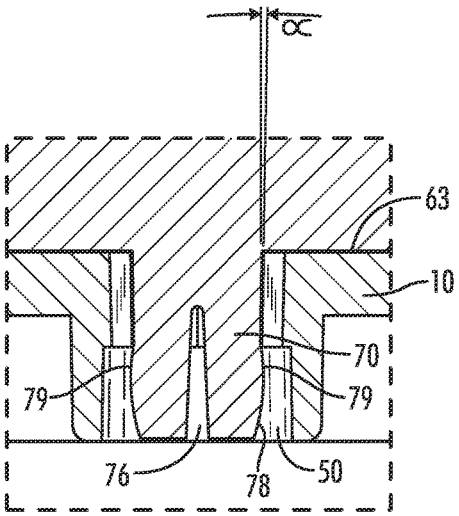
FIG. 38 depicts a side view of an alternate embodiment of FIG. 37 in which the bottom portion of the aperture is cylindrical.

Preferably, as best seen in FIGS. 19-25, the plurality of shaft seats/apertures 50 each comprise a segment that is generally in the shape of a star with a central rectangular bore 51 and a plurality of triangular projections 52 spaced evenly apart around the rectangular bore 51 and radiating at different angles from the rectangular bore 51. For example, if the aperture 50 has eight triangular projections 52, the apices 130 of the triangular projections 52 may be located 45 degrees apart (i.e., the first apex 130 will point at 0 degrees, the second apex 130 will point at 45 degrees, the third apex 130 will point at 90 degrees, the fourth apex 130 will point at 135 degrees, the fifth apex 130 will point at 180 degrees, the sixth apex 130 will point at 225 degrees, the seventh apex 130 will point at 270 degrees, and the eighth apex 130 will point at 315 degrees). As used herein, "a segment" encompasses both a short segment of aperture 50 and the entire aperture 50. In a particularly preferred embodiment, the segment of the plurality of shaft seats/apertures 50 are in the shape of a squared octagonal star, as best seen in FIG. 30 and also seen in FIGS. 26, 29, and 34 for example. As shown in FIGS. 33 and 37, the entire aperture 50 may be in the shape of a star or, as shown in FIGS. 33A and 38, only the top segment of the aperture 50 may be in the shape of a star. In the preferred embodiment, only the top segment of the aperture 50 may be in the shape of a star for ease of manufacturing. Having a segment of the apertures 50 in the shape of a star is preferred because each shaft/peg 70 is configured to removably lock to an aperture 50 at a plurality of angles by inserting a shaft/peg 70 downwardly into an aperture 50. In other words, the shaft/peg 70 may removably lock via a lock/press fit by inserting the shaft/peg 70 into the aperture 50. Preferably, the shaft/peg width 74 is substantially equal to shaft/peg length 75—i.e., square—i.e., as best seen in FIGS. 20, 21, 31 and 32 for example—though the shaft/peg 70 may be tapered along its height 73. FIGS. 31 and 32 illustrate insertion of the shaft/peg 70 into a squared octagonal star-shaped aperture 50 at two different orientations. Preferably, as shown in FIGS. 31 and 32, insertion of the shaft/peg 70 downwardly into the aperture 50 is configured to cause the shaft/peg 70 to enter the rectangular (preferably square-shaped) bore 51 of aperture 50 and some but not all of the projections 52 of apertures 51. Due to the fact that the aperture 50 preferably has eight equally sized triangular projections 52, the peg has four equally sized sides (i.e., the peg/shaft length 75 is substantially equal to the peg/shaft width 74), the panel 61 may be oriented in three orientations: 1) with panel length 65 parallel to the base length 11; 2) with panel length 65 parallel to the base width 12; and 3) with panel length 65 at 45 degrees to the base length 11 and base width 12, as shown in FIG. 29.

Optionally, each shaft/peg 70 has a shaft/peg relaxed state in which the plurality arms of the shaft/peg arms 77A and 77B are located a first distance apart and a shaft/peg compressed state in which the plurality of shaft/peg arms 77A and 77B are located a second distance apart, the second distance less than the first distance, and further wherein insertion of the shaft/peg 70 downwardly into the aperture 50 is configured to cause the shaft/peg 70 to automatically move from the shaft/peg relaxed state to the shaft/peg compressed state. In other words, the shaft slot/slit 76 allows a slight contraction of the shaft/peg 70 during insertion of the shaft/peg 70 to create the removable lock/press fit. The movement is automatic, meaning that the user does not need to compress the arms 77A and 77B together to insert the shaft/peg 70 into the aperture 50.

Figure 23:
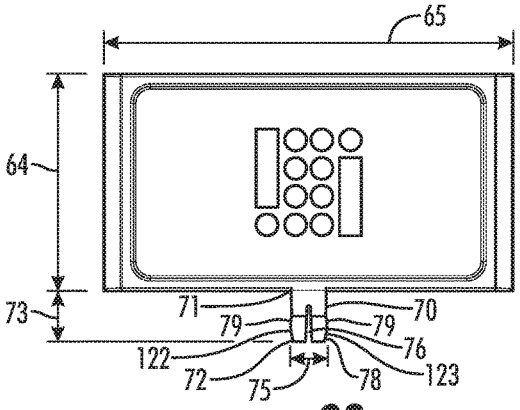
FIG. 23 depicts a side elevation view of a separator of the compartmentalization assembly of FIG. 17.

Preferably, the shaft 70 is compressible in the lengthwise direction (denoted by numeral 75) but not the widthwise direction (denoted by numeral 74) due to shaft slot 76. Preferably, the shaft length 75 is tapered/non-uniform as best seen in FIG. 23 and FIG. 38 and has an upper chamfer 79 to aid in removal of the peg/shaft 70. By contrast, the front 120 and rear 121 of the peg/shaft may be flat. Similarly, the top segment of apertures 50 may be angled at angle $\alpha$ slightly inwardly as best seen in FIG. 38 to aid in insertion of the pegs 50.

Optionally, the base 10 and pegs/shaft 70 are semi-rigid or rigid (e.g., plastic).

Figure 24:
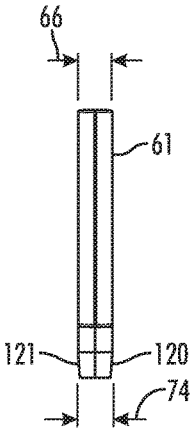
FIG. 24 depicts a side elevation view of a separator of the compartmentalization assembly of FIG. 17.
Figure 25:
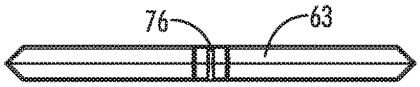
FIG. 25 depicts a bottom plan view of a separator of the compartmentalization assembly of FIG. 17.

Optionally, the shaft/peg bottom 72 comprises at least two shaft/peg rounded edges 78 located on opposite shaft/peg arms 77A and 77B of the shaft/peg 70, as best seen in FIGS. 23-24.

Optionally, the plurality of shaft seats/apertures 50 are spaced apart at regular intervals. For example, in a preferred embodiment, the distance between the plurality of apertures 50 is the same throughout the base 10. In an exemplary embodiment, the plurality of apertures 50 are between about 0.25 inches to about 0.75 inches apart, however, this distance is merely exemplary and will vary depending on the size of the separators 60. Optionally, the plurality of apertures 50 are evenly distributed about the base 10 and arranged in a plurality of rows and columns.

Figure 22:
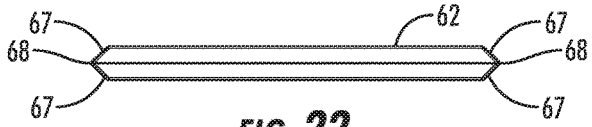
FIG. 22 depicts a top plan view of a separator of the compartmentalization assembly of FIG. 17.

Optionally, the panels 61 are generally rectangular in shape, as best seen in FIGS. 22-24. Optionally, the opposing lengthwise 65 edges of the panels 61 each include two 45 degree chamfers that meet at an apex 68 so that a panel 61 oriented in the lengthwise direction (i.e., where the length 65 of the panel 61 is parallel to the base length 11) may form a closed compartment when it meets a panel 61 oriented in the widthwise direction (i.e., where the length 65 of the panel 61 is parallel to the base width 12), as shown in FIG. 29.

Figure 26:
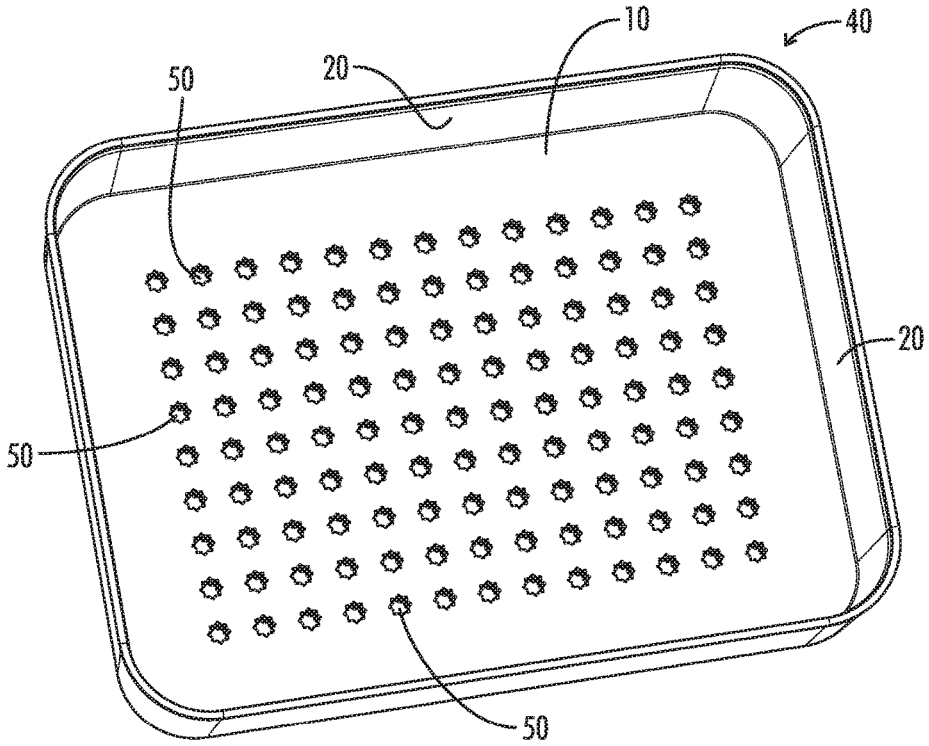
FIG. 26 depicts a top perspective view of the compartmentalization assembly of FIG. 17.
Figure 27:
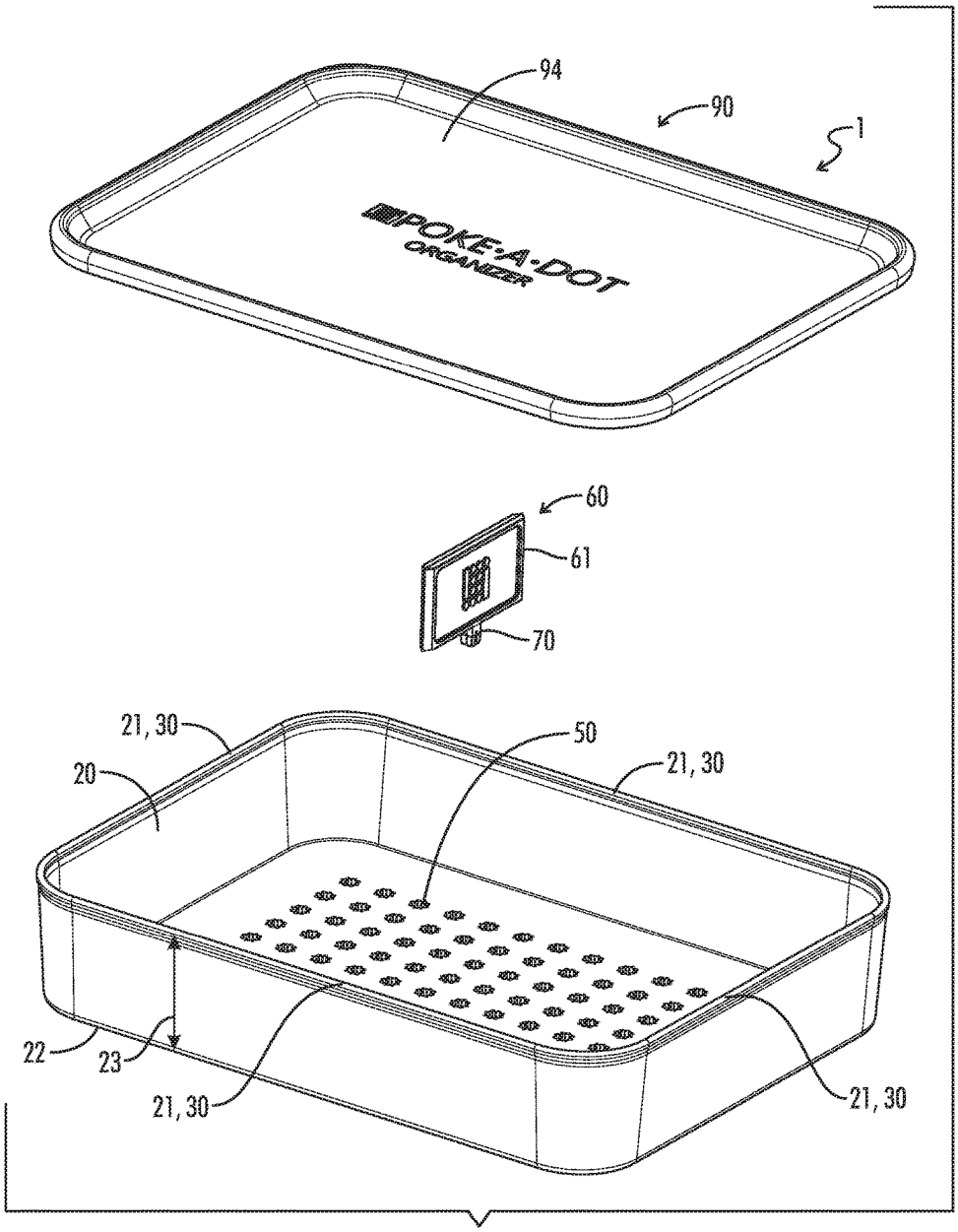
FIG. 27 depicts a top exploded perspective view of the compartmentalization assembly of FIG. 17.
Figure 28:
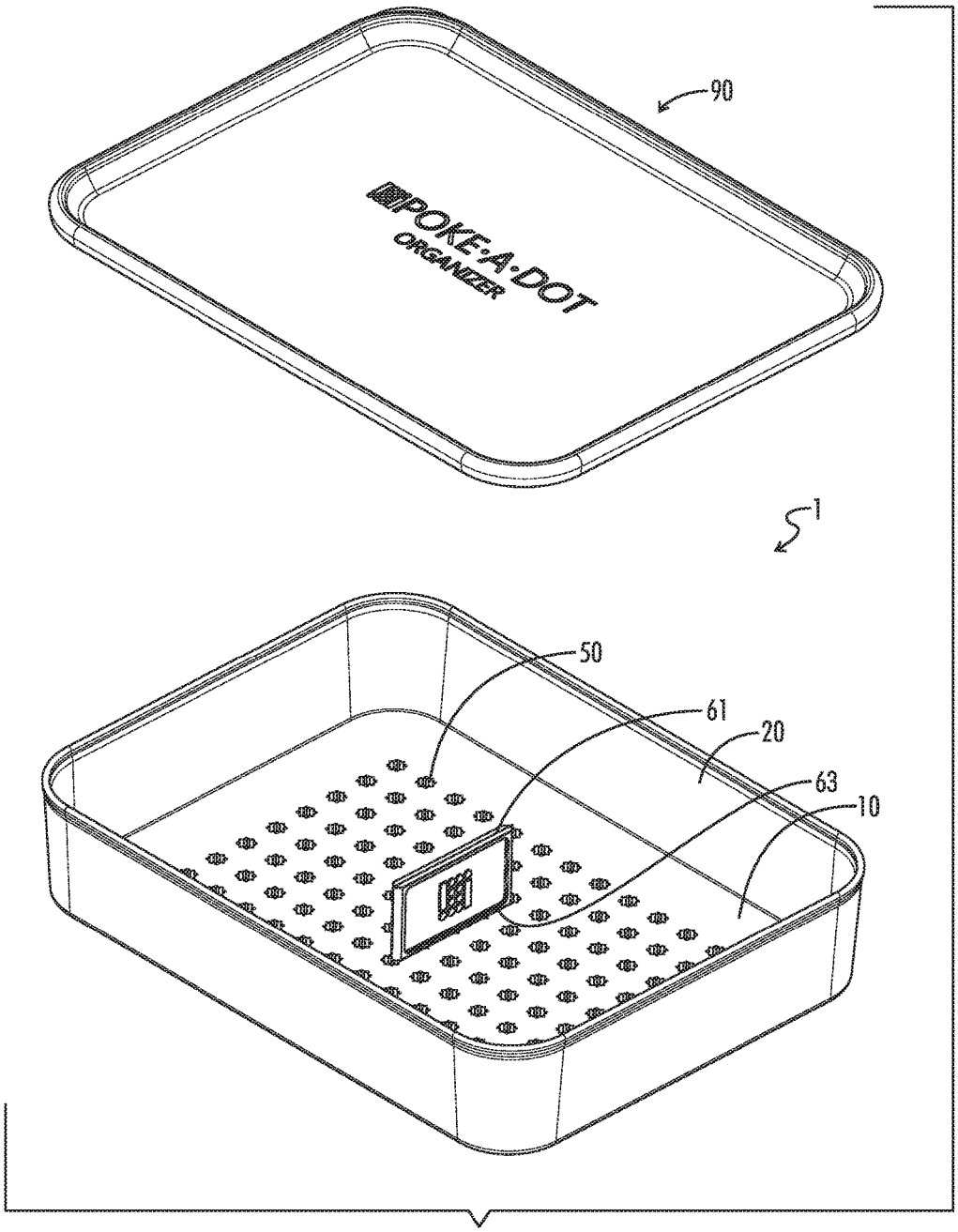
FIG. 28 depicts a top partially exploded perspective view of the compartmentalization assembly of FIG. 17.
Figure 36:
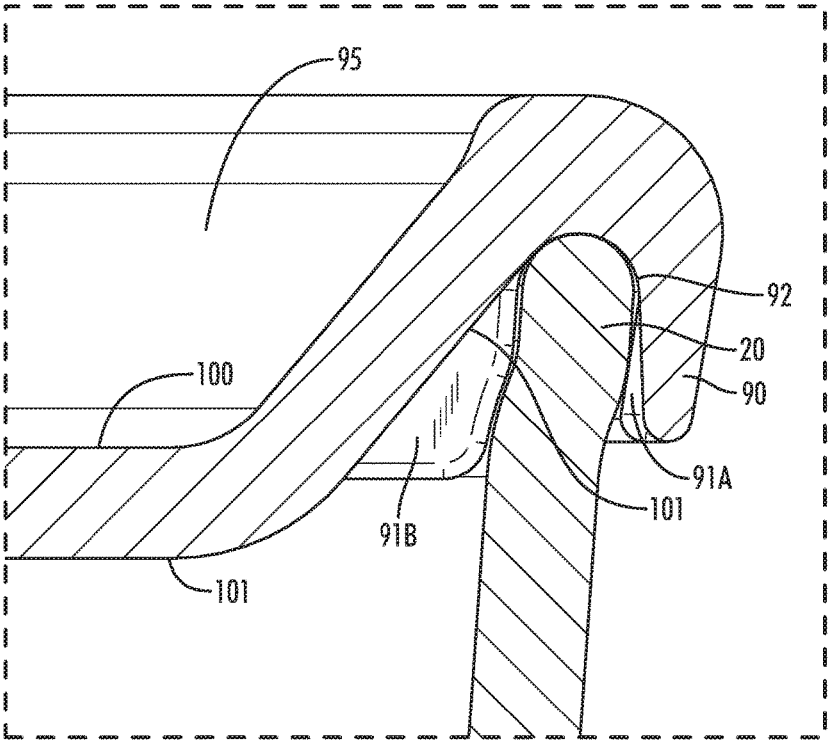
FIG. 36 depicts a side view of the area circled 36 in FIG. 35.

Optionally, the compartmentalization assembly 1 comprises at least one wall 20 extending upwardly above the base 10 (preferably bordering the base 10 and extending about a perimeter of the base 10), and an open top opposite the base 10, as seen in FIGS. 26-29. (In other words, the base 10 and the at least one wall 20 may be part of a container 40). As shown in FIGS. 26-29, for example, the base 10 and at least one wall 20 may be a single piece of injected molded plastic. Optionally, the at least one wall 20 comprises a top end 21 forming a rim 30, as best seen in FIGS. 26-28. The at least one wall 20 may also include a bottom end 22 and a wall height 23 extending from the top end 21 to the bottom end 22. Optionally, the compartmentalization assembly 1 further comprises a removable lid 90 to removably close the open top. Optionally, the lid 90 comprises a lid top surface 100, a lid bottom surface 101 opposite the lid top surface 100 and configured to face the base 10, a lid groove 92 extending around the lid bottom surface 101 (e.g., forming a closed perimeter), and a plurality of lid tabs 91A and 91B on opposite sides of the lid groove 92, and further wherein each at least one wall 20 is configured to removably lock to the lid 90 by inserting the at least one wall 20 upwardly into the lid groove 92 via a lock/press fit, as best seen in FIG. 36. More particularly, optionally, insertion of the at least one wall 20 upwardly into the lid groove 92 is configured to cause lid tabs 91A and 91B on opposite of the lid grooves 92 to move away from each other/flex to allow the lid 90 to removably lock to the at least one wall 20.

Optionally, the lid 90 has a lid handle 93.

Optionally, the lid 90 comprises a lid top surface 100 comprising at least one wall 95 extending about a perimeter of the lid top surface 100 and creating a lid top surface lid recess 94. Optionally, the container 40 further comprises a container bottom 41, and further wherein the container bottom 41 is configured to rest on the lid top surface lid recess 94 and the container bottom 41 is configured to partially nest on the lid 90. In other words, the lid top surface lid recess 94 may have a lid recess length 98 and lid recess width 99 that is substantially equal to the container bottom length 96 and container bottom width 97 to enable stacking.

Optionally, the lid 90 and the base 10 and the panels 61 are generally rectangular in shape.

Optionally, the base 10 comprises a base height, wherein each aperture 50 has an aperture height generally parallel to the base height and further wherein each aperture 50 extends through the base height. In other words, the shaft seats/apertures 50 may pass entirely through the base 10, as shown in FIGS. 34-35 and 37-38 for example.

Figure 35:
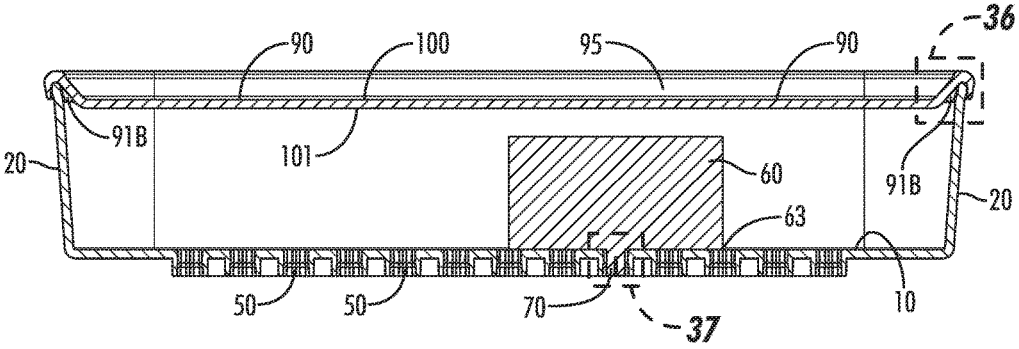
FIG. 35 depicts a sectional view of compartmentalization assembly of FIG. 17 taken along line 35-35 of FIG. 34.

Optionally, when a shaft/peg 70 of a separator 60 is inserted downward and locked into an aperture 50, the separator 60 is located below the rim 30, as shown in FIG. 35 and FIG. 29 for example. In other words, the wall height 23 may be greater than panel height 64 to allow for stacking of containers 40 if lids 90 are not used.

Optionally, the plurality of shaft seats/apertures 50 are approximately the same size and shape. Optionally, the pegs/shaft 70 of each separator 60 are approximately the same size and shape.

Optionally, the panel 61 of a separator 60 comprises a panel bottom 63 confronting the base 10 when the shaft/peg 70 is inserted downwardly into the aperture 50, as best seen in FIGS. 29 and 35 for example. The panel may further include a panel top 62 and a panel height 64.

The present disclosure further provides a method of utilizing a compartmentalization assembly 1 comprising the steps of: a) providing the compartmentalization assembly 1; and b) inserting a shaft/peg 70 of a separator 60 downwardly into a aperture 50 to removably lock the separator 60 to the base 10. Optionally, the method further includes: c) removing the shaft/peg 70 from the aperture 50; d) rotating the shaft/peg 70; and e) re-inserting the shaft/peg 70 into the aperture 50.

| Part List | |
|---|---|
| assembly | 1 |
| Base | 10 |
| Base length | 11 |
| Base width | 12 |
| at least one wall | 20 |
| at least one wall top | 21 |
| at least one wall bottom | 22 |
| wall height | 23 |
| rim | 30 |
| container | 40 |
| container bottom | 41 |
| shaft seats/apertures | 50 |
| rectangular bore of aperture | 51 |
| projections of aperture | 52 |
| separator | 60 |
| panel | 61 |
| panel top | 62 |
| panel bottom | 63 |
| panel height | 64 |
| panel length | 65 |
| panel width | 66 |
| Panel chamfer edge | 67 |
| apex | 68 |
| shaft/peg | 70 |
| peg top | 71 |
| peg bottom | 72 |
| peg height | 73 |
| peg width | 74 |
| peg length | 75 |
| shaft slot/slit | 76 |
| shaft arms | 77A and 77B |
| shaft rounded edge | 78 |
| upper chamfer | 79 |
| lid | 90 |
| lid tabs | 91A and 91B |
| lid groove | 92 |
| lid handle | 93 |
| lid recess | 94 |
| lid wall | 95 |
| container bottom length | 96 |
| container bottom width | 97 |
| lid recess length | 98 |
| lid recess width | 99 |
| Lid top surface | 100 |
| Lid bottom surface | 101 |
| Peg/shaft front | 120 |
| Peg/shaft rear | 121 |
| Peg/shaft left side | 122 |
| Peg/shaft right side | 123 |
| Apex of triangular projection | 130 |

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

Each and every patent or other publication or published document referred to in any portion of this specification is incorporated in toto into this disclosure by reference, as if fully set forth herein.

This invention is susceptible to considerable variation in its practice. Therefore the foregoing description is not intended to limit, and should not be construed as limiting, the invention to the particular exemplifications presented hereinabove.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously.

What is claimed is:

1. A compartmentalization assembly comprising:

a) a base comprising a plurality of apertures; and b) a plurality of separators, each separator comprising a panel having a panel height, a panel length generally perpendicular to the panel height, and a panel width generally perpendicular to the panel height and panel length, and a peg extending generally downward from the panel and comprising a peg bottom, a peg top, a peg height generally parallel to the panel height, a peg length generally parallel to the panel length, and a peg width generally parallel to the panel width, wherein each peg further comprises a plurality of arms and a slot extending upward from the peg bottom toward the peg top, the slot separating the plurality of arms, wherein the plurality of apertures each comprise a segment that is generally in the shape of a star with a central rectangular bore and a plurality of projections spaced evenly apart around the rectangular bore and radiating from the rectangular bore at different angles; and further wherein each peg is configured to removably lock to an aperture at a plurality of angles by inserting a peg into an aperture at the plurality of angles.

2. The compartmentalization assembly of claim 1 wherein each aperture has eight triangular projections, the eight triangular projections having substantially the same size, and further wherein the peg has four sides, and further wherein the peg lengths are substantially equal to the peg widths, and further wherein each triangular projection comprises an apex, and further wherein the apices of the triangular projections are spaced approximately 45 degrees apart.

3. The compartmentalization assembly of claim 1 wherein the slot extends the full width but not the full length of each peg.

4. The compartmentalization assembly of claim 1 wherein each peg has a relaxed state in which the plurality of arms of the peg are located a first distance apart and a compressed state in which the plurality of arms of the peg are located a second distance apart, the second distance less than the first distance, and further wherein insertion of the peg downwardly into the aperture is configured to automatically cause the peg to move from the relaxed state to the compressed state.

5. The compartmentalization assembly of claim 1 wherein the segments of the plurality of apertures are in the shape of a squared octagonal star.

6. The compartmentalization assembly of claim 1 wherein insertion of the peg downwardly into the aperture is configured to cause the peg to enter the rectangular bore and some but not all of the projections.

7. The compartmentalization assembly of claim wherein 1 the base and pegs are semi-rigid or rigid.

8. The compartmentalization assembly of claim 1 wherein the peg bottom comprises at least two rounded edges.

9. The compartmentalization assembly of claim 1 wherein the plurality of apertures are evenly distributed about the base and arranged in a plurality of rows and columns.

10. The compartmentalization assembly of claim 1 further comprising at least one wall extending upwardly above the base, and an open top opposite the base.

11. The compartmentalization assembly of claim 10 wherein the at least one wall and the base form a container, and further wherein the at least one wall comprises a top end forming a rim of the container.

12. The compartmentalization assembly of claim 10 further comprising a removable lid to removably close the open top.

13. The compartmentalization assembly of claim 12 wherein the lid comprises a top surface, a bottom surface opposite the top surface and configured to face the base, a groove extending around the bottom surface and a plurality of tabs on opposite sides of the groove, and further wherein the at least one wall is configured to removably lock to the lid by inserting the wall upwardly into the groove.

14. The compartmentalization assembly of claim 13 wherein insertion of the at least one wall upwardly into the groove is configured to cause tabs on opposite sides of the groove to move away from each other and flex to allow the lid to removably lock to the at least one wall.

15. The compartmentalization assembly of claim 12 wherein the lid comprises a top surface comprising at least one wall extending about a perimeter of the top surface and forming a top surface recess, wherein the container further comprises a container bottom, and further wherein the container bottom is configured to rest on the top surface recess.

16. The compartmentalization assembly of claim 12 wherein the lid and the base are generally rectangular in shape.

17. The compartmentalization assembly of claim 11 wherein, when a peg of a separator is inserted downward and locked into an aperture, the separator is located below the rim.

18. The compartmentalization assembly of claim 1 wherein the plurality of apertures are approximately the same size and shape.

19. The compartmentalization assembly of claim 1 wherein each panel has a single peg located approximately in the center of the panel length.

20. The compartmentalization assembly of claim 1 wherein the panel of a separator comprises a panel bottom confronting the base when the peg is inserted downwardly into the aperture.

21. A method of utilizing a compartmentalization assembly comprising the steps of:

a) providing the compartmentalization assembly of claim 1; and b) inserting a peg of a separator downwardly into an aperture to removably lock the separator to the base.

22. The method of claim 21, further comprising the steps of:

c) removing the peg from the aperture;

d) rotating the peg; and e) re-inserting the peg into the aperture.

* * * * *